US010994551B2

(12) United States Patent
Tokisawa et al.

(10) Patent No.: US 10,994,551 B2
(45) Date of Patent: May 4, 2021

(54) PRINTING APPARATUS AND A CONTROL METHOD

(71) Applicant: CANON KABUSHIKI KAISHA, Tokyo (JP)

(72) Inventors: Toshiaki Tokisawa, Kawasaki (JP); Kyoshiro Okude, Kawasaki (JP); Yumi Mukoyama, Kawasaki (JP); Ryoma Arai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/288,729

(22) Filed: Feb. 28, 2019

(65) Prior Publication Data

US 2019/0299648 A1 Oct. 3, 2019

(30) Foreign Application Priority Data

Mar. 29, 2018 (JP) ..... JP2018-065381
Sep. 14, 2018 (JP) ..... JP2018-172667

(51) Int. Cl.
*B41J 2/175* (2006.01)
*B41J 2/18* (2006.01)

(52) U.S. Cl.
CPC ..... *B41J 2/17596* (2013.01); *B41J 2/17509* (2013.01); *B41J 2202/12* (2013.01)

(58) Field of Classification Search
CPC ..... B41J 2/17596; B41J 2/18; B41J 2/17509; B41J 2/17506
See application file for complete search history.

(56) References Cited

U.S. PATENT DOCUMENTS 6,168,268 B1 * 1/2001 Sugiyama ..... B41J 2/17509 347/89
2008/0231676 A1 * 9/2008 Shimizu ..... B41J 2/17513 347/86
2017/0326882 A1 11/2017 Okude et al. ..... B41J 2/01
2019/0009557 A1 1/2019 Arai et al. ..... B41J 2/17596
2019/0009561 A1 1/2019 Mukoyama et al. ..... B41J 2/21
2019/0009562 A1 1/2019 Abe et al. ..... B41J 2/16505
2019/0009563 A1 1/2019 Tokisawa et al. ... B41J 2/17596

FOREIGN PATENT DOCUMENTS

JP 2005-001286 1/2005

* cited by examiner

*Primary Examiner* — Jason S Uhlenhake
(74) *Attorney, Agent, or Firm* — Venable LLP

(57) ABSTRACT

An object of the present invention is to prevent a sub tank the does not need replenishment from being replenished with ink. The present invention is a printing apparatus that includes: a print head; a sub tank; a main tank; a supply valve; an atmosphere release valve; and one pump, and performs a replenishment operation to replenish the sub tank with ink from the main tank by driving the pump in a state where the atmosphere release valve is closed and the supply valve is open, wherein a second ink, and a third ink, and in a case where replenishment of a first ink and the third ink is necessary and replenishment of the second ink is not necessary, the atmosphere release valve is opened after the supply valve of the first ink is closed and before the supply valve of the second ink is opened.

12 Claims, 16 Drawing Sheets

| | | Cam movement direction → | | | | | | | | | | | | |
|---|---|---|---|---|---|---|---|---|---|---|---|---|---|---|
| Cam position | | A | B | C | D | E | F | G | H | I | J | K | L | M |
| Tank supply valve | $V1_{Bk}$ | OPEN | CLOSE | OPEN | CLOSE | CLOSE | CLOSE | CLOSE | CLOSE | CLOSE | CLOSE | CLOSE | CLOSE | CLOSE |
| | $V1_{C}$ | CLOSE | CLOSE | CLOSE | OPEN | CLOSE | OPEN | CLOSE | CLOSE | CLOSE | CLOSE | CLOSE | CLOSE | CLOSE |
| | $V1_{M}$ | CLOSE | CLOSE | CLOSE | CLOSE | CLOSE | CLOSE | OPEN | CLOSE | OPEN | CLOSE | CLOSE | CLOSE | CLOSE |
| | $V1_{Y}$ | CLOSE | CLOSE | CLOSE | CLOSE | CLOSE | CLOSE | CLOSE | CLOSE | CLOSE | OPEN | CLOSE | OPEN | CLOSE |

FIG.12

| | | ← Cam movement direction → | | | | | | | |
|---|---|---|---|---|---|---|---|---|---|
| Cam position | | A | B | C | D | E | F | G | H |
| Tank supply valve | $V1_{Bk}$ | OPEN | CLOSE | CLOSE | CLOSE | CLOSE | CLOSE | CLOSE | CLOSE |
| | $V1_{C}$ | CLOSE | CLOSE | OPEN | CLOSE | CLOSE | CLOSE | CLOSE | CLOSE |
| | $V1_{M}$ | CLOSE | CLOSE | CLOSE | CLOSE | OPEN | CLOSE | CLOSE | CLOSE |
| | $V1_{Y}$ | CLOSE | CLOSE | CLOSE | CLOSE | CLOSE | CLOSE | OPEN | CLOSE |

FIG.13

PRINTING APPARATUS AND A CONTROL METHOD

BACKGROUND OF THE INVENTION

Field of the Invention

The present invention relates to a printing apparatus and a control method.

Description of the Related Art

Japanese Patent Laid-Open No. 2005-001286 has disclosed a printing apparatus having a main tank, a sub tank, a drive valve arranged in an ink flow path connecting the main tank and the sub tank, and a pump that makes negative the pressure within the sub tank. In this printing apparatus, the pump is used in common for all color inks, but on the other hand, it is possible to control the drive valve for each color ink independently and by making negative the pressure within the sub tank into by using the pump in a state where the drive valve is left open, the sub tank is replenished with ink from the main tank.

SUMMARY OF THE INVENTION

However, in the printing apparatus of Japanese Patent Laid-Open No. 2005-001286, depending on order in which the drive valves are opened and closed and arrangement order of the sub tank that needs replenishment of ink, the valve is opened also for the sub tank that does not need replenishment of ink, and therefore, there is a case where the sub tank is replenished with ink excessively. As a result of this, there is a possibility that ink overflows from the sub tank.

Consequently, in view of the above-described problem, an object of the present invention is to prevent, in a case where the sub tanks are replenished with ink in order different from color order of opening of the drive valves, a sub tank that does not need replenishment from being replenished with ink in the above-described configuration.

The present invention is a printing apparatus that includes: a print head capable of ejecting a first ink, a second ink, and a third ink; a sub tank provided for each ink color and storing the ink to be supplied to the print head; a main tank provided for each ink color and storing the ink with which the sub tank is replenished; a supply valve provided for each ink color and opening and closing an ink flow path connecting the main tank and the sub tank; an atmosphere release valve provided for each ink color and for opening the inside of the of the sub tank to the atmosphere; and one pump for making negative the pressure within the sub tank, and performs a replenishment operation to replenish the sub tank with ink from the main tank by driving the pump in a state where the atmosphere release valve is closed and the supply valve is open, and the supply valves are capable of opening one by one in order of the first ink, the second ink, and the third ink, and in a case where replenishment of the first ink and the third ink is necessary and replenishment of the second ink is not necessary, the atmosphere release valve is opened after the supply valve of the first ink is closed and before the supply valve of the second ink is opened.

Further features of the present invention will become apparent from the following description of exemplary embodiments with reference to the attached drawings.

BRIEF DESCRIPTION OF THE DRAWINGS

FIG. 12 is a table showing combinations of opening and closing of tank supply valves in the fourth embodiment;

FIG. 13 is a table showing combinations of opening and closing of the tank supply valves in the fourth embodiment.

DESCRIPTION OF THE EMBODIMENTS

In the following, with reference to the drawings, a liquid ejection head and a liquid ejection apparatus according to embodiments of the present invention are explained. In the following embodiments, an ink jet print head that ejects ink and an ink jet printing apparatus are explained with a specific configuration, but the present invention is not limited to this. It is possible to apply the liquid ejection head, the liquid ejection apparatus, and a liquid supply method of the present invention to a printer, a copy machine, a facsimile having a communication system, an apparatus, such as a word processor having a printer unit, and further, to an industrial printing apparatus combined compositely with various processing apparatuses. For example, it is possible to use the present invention for use of biochip manufacturing, electronic circuit printing, and so on. Further, the embodiments described below are specific examples of the present invention, and therefore, a variety of technically favorable restrictions are imposed. However, as long as the sprit of the present invention is observed, the embodiments are not limited to those described below or other specific methods.

First Embodiment

<About Internal Configuration of Printing Apparatus>

Figure 1:
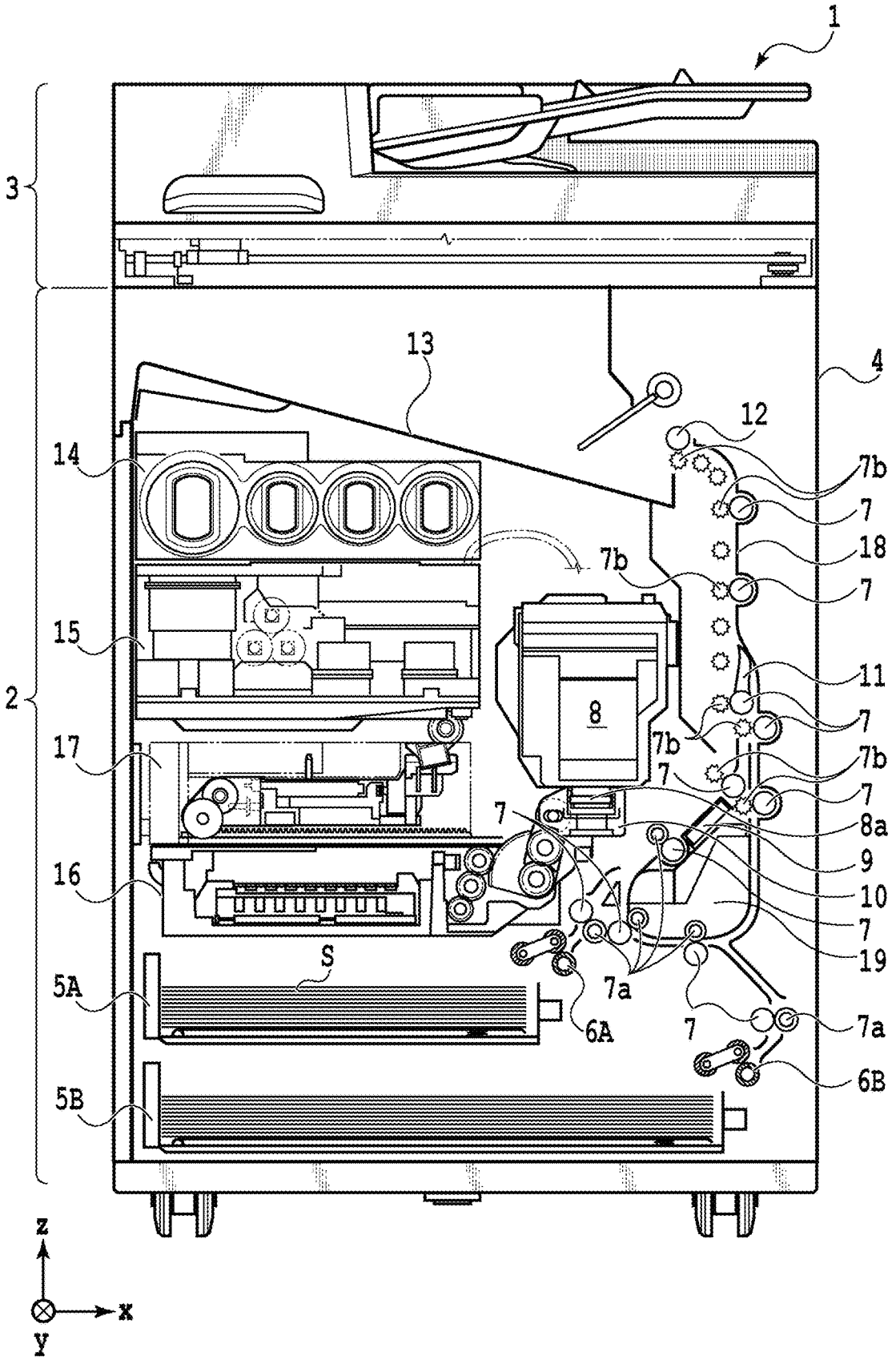
FIG. 1 is a diagram in a case where a printing apparatus is in a standby state in a first embodiment.

FIG. 1 is an internal configuration diagram of an ink jet printing apparatus 1 (hereinafter, printing apparatus 1). In FIG. 1, the x-direction indicates the horizontal direction, the y-direction (direction perpendicular to the paper surface) indicates the direction in which ejection ports are arrayed in a print head 8, to be described later, and the z-direction indicates the vertical direction, respectively.

The printing apparatus 1 is a multi function printer including a print unit 2 and a scanner unit 3 and capable of performing a variety of kinds of processing relating to the printing operation and the reading operation by the print unit 2 and the scanner unit 3 individually, or by an interlocking manner of the print unit 2 and the scanner unit 3. The scanner unit 3 includes an ADF (Auto Document Feeder) and an FBS (Flat Bed Scanner) and is capable of reading of a document automatically fed by the ADF and reading (scanning) of a document placed on a document table of the FBS by a user. Here, the multi function printer having both the print unit 2 and the scanner unit 3 is shown, but the multi function printer may be an aspect in which the scanner unit 3 is not included. FIG. 1 shows a case where the printing apparatus 1 is in a standby state where the printing apparatus 1 is performing neither the printing operation nor the reading operation.

In the print unit 2, at the bottom in the vertically downward direction of a casing 4, a first cassette 5A and a second cassette 5B for storing a printing medium (cut sheet) S are installed in an attachable and detachable manner. In the first cassette 5A, comparatively small printing media up to the A4 size, and in the second cassette 5B, comparatively large printing media up to the A3 size are stored in a piled-up manner. In the vicinity of the first cassette 5A, a first feed unit 6A for feeding stored printing media by separating one by one is provided. Similarly, in the vicinity of the second cassette 5B, a second feed unit 6B is provided. In a case where the printing operation is performed, the printing medium S is selectively fed from one of the cassettes.

A conveyance roller 7, a discharge roller 12, a pinch roller 7*a*, a spur 7*b*, a guide 18, an inner guide 19, and a flapper 11 are conveyance mechanisms for guiding the printing medium S in a predetermined direction. The conveyance roller 7 is arranged on the upstream side and on the downstream side of the print head 8 and is a drive roller that is driven by a conveyance motor, not shown schematically. The pinch roller 7*a* is a follower roller that nips and rotates the printing medium S together with the conveyance roller 7. The discharge roller 12 is arranged on the downstream side of the conveyance roller 7 and is a drive roller that is driven by a conveyance motor, not shown schematically. The spur 7*b* sandwiches and conveys the printing medium S together with the conveyance roller 7 arranged on the downstream side of the print head 8 and the discharge roller 12.

The guide 18 is provided in the conveyance path of the printing medium S and guides the printing medium S in a predetermined direction. The inner guide 19 is a member extending in the y-direction and has a curved side surface, and guides the printing medium S along the side surface. The flapper 11 is a member for switching directions in which the printing medium S is conveyed at the time of the both-side printing operation. A discharge tray 13 is a tray for loading and holding the printing medium S for which the printing operation has been completed and which is discharged by the discharge roller 12.

The print head 8 is a color ink jet print head of full line type and in which a plurality of ejection ports from which ink is ejected in accordance with print data is arrayed along the y-direction in FIG. 1 so as to correspond to the width of the printing medium S. In a case where the print head 8 is at the standby position, an ejection port surface 8*a* faces in the vertically downward direction and is capped by a cap unit (also called cap mechanism) 10 as shown in FIG. 1. In a case where the printing operation is performed, by a print controller 202, to be described later, the direction of the print head 8 is changed so that the ejection port surface 8*a* faces a platen 9. The platen 9 is configured by a flat plate extending in the y-direction and supports the printing medium S from the rear side, for which the printing operation is performed by the print head 8. The movement of the print head 8 from the standby position to the printing position will be described later in detail.

An ink tank unit 14 stores four color inks to be supplied to the print head 8, respectively. The four color inks here refer to inks of cyan (C), magenta (M), yellow (Y), and black (Bk). An ink supply unit 15 is provided on the way in the flow path connecting the ink tank unit 14 and the print head 8 and adjusts the pressure and the amount of flow of the ink within the print head 8 to an appropriate range. The printing apparatus 1 has a circulation-type ink supply system and the ink supply unit 15 adjusts the pressure of the ink supplied to the print head 8 and the amount of flow of the ink recovered from the print head 8 to an appropriate range.

A maintenance unit 16 includes the cap unit 10 and a wiping unit 17 and performs the maintenance operation for the print head 8 by causing these units to operate at predetermined timing.

<About Control Configuration of Printing Apparatus>

Figure 2:
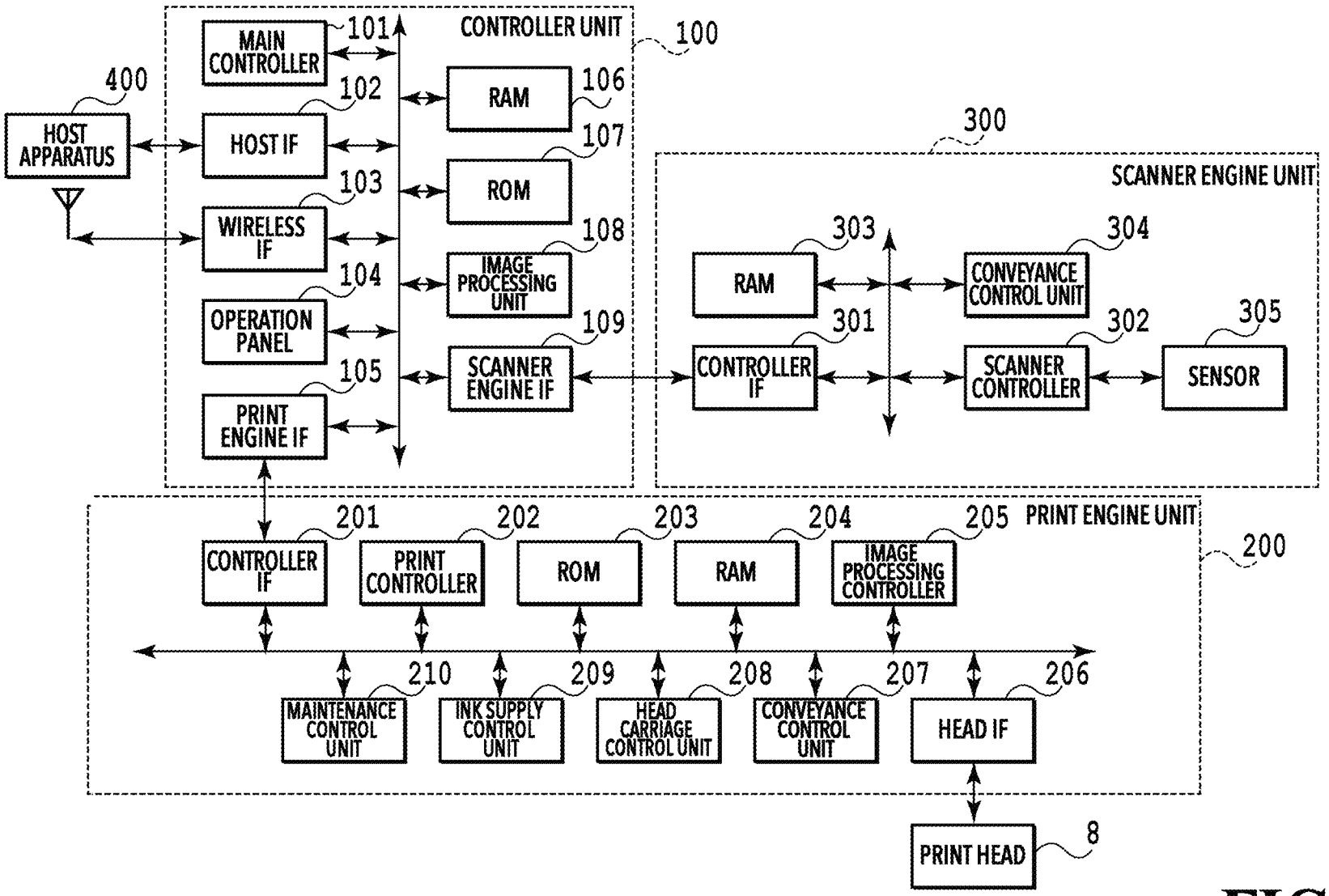
FIG. 2 is a block diagram showing a control configuration of the printing apparatus in the first embodiment.

FIG. 2 is a block diagram showing a control configuration in the printing apparatus 1. The printing apparatus 1 mainly includes a print engine unit 200 configured to centralizedly control the print unit 2, a scanner engine unit 300 configured to centralizedly control the scanner unit 3, and a controller unit 100 configured to centralizedly control the entire printing apparatus 1. The print controller 202 controls various mechanisms of the print engine unit 200 in accordance with instructions of a main controller 101 of the controller unit 100. Various mechanisms of the scanner engine unit 300 are controlled by the main controller 101 of the controller unit 100. In the following, details of the control configuration are explained.

In the controller unit 100, the main controller 101 including a CPU controls the entire printing apparatus 1 by using a RAM 106 as a work area in accordance with programs and various parameters stored in a ROM 107. For example, in a case where a print job is input from a host apparatus 400 via a host I/F 102 or a wireless I/F 103, predetermined image processing is performed for image data received by an image processing unit 108 in accordance with instructions of the main controller 101. Then, the main controller 101 transmits the image data for which image processing has been performed to the print engine unit 200 via a print engine I/F 105.

The printing apparatus 1 may acquire image data from the host apparatus 400 via wireless communication or wired communication or may acquire image data from an external storage device (USB memory and the like) connected to the printing apparatus 1. The communication method that is made use of for wireless communication or wired communication is not limited. For example, as the communication method that is made use of for wireless communication, it is possible to apply Wi-Fi (Wireless Fidelity) (registered trademark) and Bluetooth (registered trademark). Further, as the communication method that is made use of for wired communication, it is possible to apply USB (Universal Serial Bus) and the like. Furthermore, for example, in a case where a read command is input from the host apparatus 400, the main controller 101 transmits this command to the scanner engine unit 300 via a scanner engine I/F 109.

An operation unit 104 is a mechanism for a user to input and output for the printing apparatus 1. It is possible for a user to give instructions as to the operation, such as copy and scan, to set a printing mode, to recognize information on the printing apparatus 1, and so on via the operation panel 104.

In the print engine unit 200, the print controller 202 including a CPU controls various mechanisms included in the print unit 2 by using a RAM 204 as a work area in accordance with programs and various parameters stored in a ROM 203. In a case where various commands and image data are received via a controller I/F 201, the print controller 202 temporarily stores them in the RAM 204. The print controller 202 causes an image processing controller 205 to convert the saved image data into print data so that the print head 8 can make use of for the printing operation. In a case where print data is generated, the print controller 202 causes the print head 8 to perform the printing operation based on the print data via a head I/F 206. At this time, the print controller 202 conveys the printing medium S by driving the feed units 6A and 6B, the conveyance roller 7, the discharge roller 12, and the flapper 11 shown in FIG. 1 via a conveyance control unit 207. In accordance with instructions of the print controller 202, the printing operation by the print head 8 is performed by interlocking the conveyance operation of the printing medium S and thus printing processing is performed.

A head carriage control unit 208 changes the direction and position of the print head 8 in accordance with the operating state, such as the maintenance state and the printing state, of the printing apparatus 1. An ink supply control unit 209 controls the ink supply unit 15 so that the pressure of the ink to be supplied to the print head 8 is adjusted within an appropriate range. A maintenance control unit 210 controls the operation of cleaning mechanisms, such as the cap unit 10 and the wiping unit 17 in the maintenance unit 16, at the time of performing the maintenance operation for the print head 8.

In the scanner engine unit 300, the main controller 101 controls hardware resources of a scanner controller 302 by using the RAM 106 as a work area in accordance with programs and various parameters stored in the ROM 107. Due to this, various mechanisms included in the scanner unit 3 are controlled. For example, by the main controller 101 controlling the hardware resources within the scanner controller 302 via a controller I/F 301, a document mounted on the ADF by a user is conveyed via a conveyance control unit 304 and read by a sensor 305. Then, the scanner controller 302 saves the read image data in a RAM 303. It is possible for the print controller 202 to cause the print head 8 to perform the printing operation based on the image data read by the scanner controller 302 by converting the image data acquired as described above into print data.

<About Operation of Printing Apparatus in Printing State>

Figure 3:
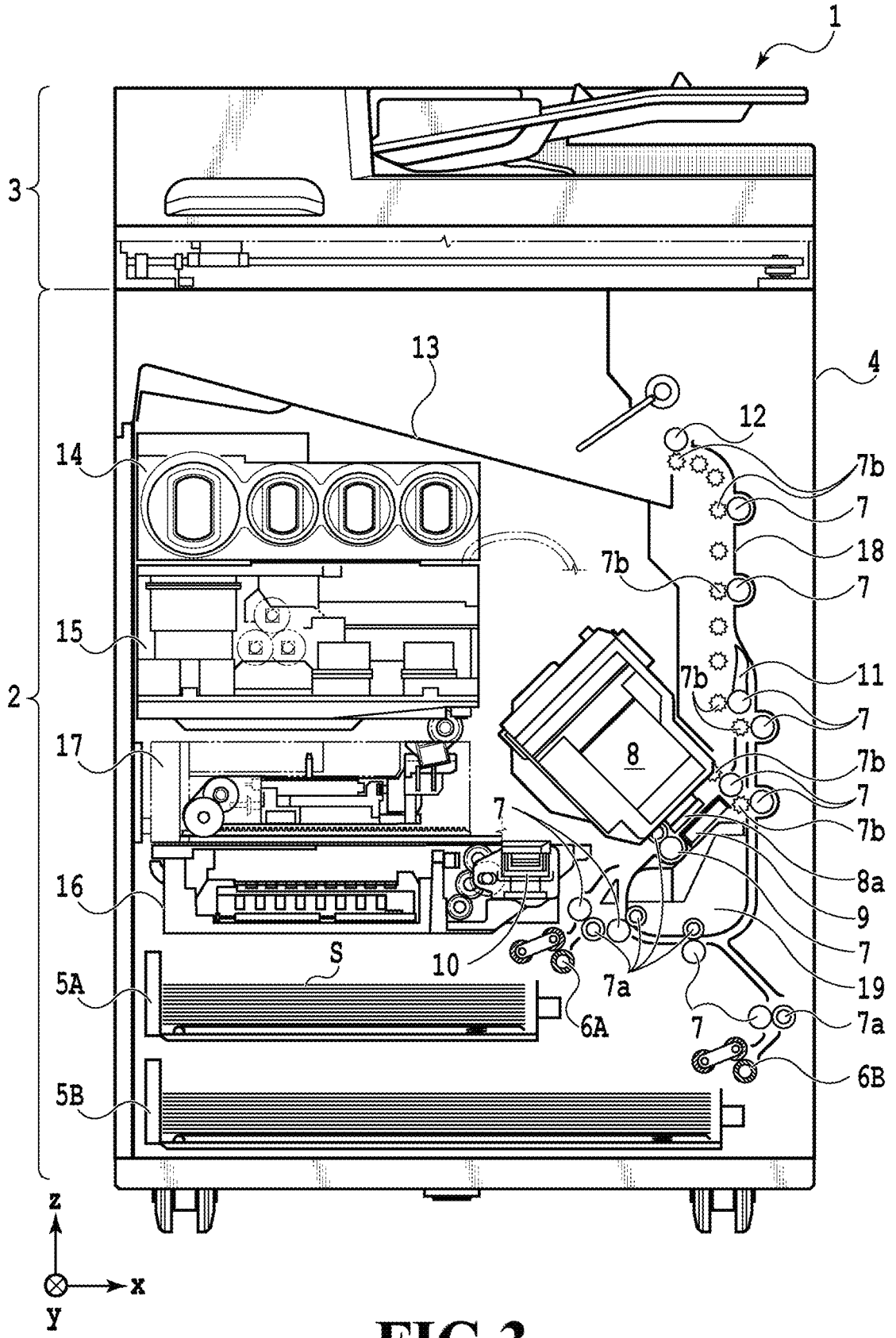
FIG. 3 is a diagram in a case where the printing apparatus is in a printing state in the first embodiment.

FIG. 3 shows a case where the printing apparatus 1 is in the printing state. Compared to the standby state shown in FIG. 1, the cap unit 10 separates from the ejection port surface 8*a* of the print head 8 and the ejection port surface 8*a* faces the platen 9. The plane of the platen 9 is inclined about 45 degrees with respect to the horizontal direction and the ejection port surface 8*a* of the print head 8 at the printing position is also inclined about 45 degrees with respect to the horizontal direction so that the distance from the platen 9 is maintained at a constant value.

At the time of moving the print head 8 from the standby position shown in FIG. 1 to the printing position shown in FIG. 3, the print controller 202 lowers the cap unit 10 down to the evacuate position shown in FIG. 3 by using the maintenance control unit 210. Due to this, the ejection port surface 8*a* of the print head 8 separates from a cap member 10*a*. After this, the print controller 202 rotates the print head 8 by 45 degrees while adjusting the height in the vertical direction of the print head 8 by using the head carriage control unit 208 and causes the ejection port surface 8*a* to face the platen 9. In a case where the printing operation is completed and the print head 8 moves from the printing position to the standby position, the process opposite to that described above is performed by the print controller 202.

In a case where a print command is input, the print controller 202 moves the print head 8 to the printing position shown in FIG. 3 by using the maintenance control unit 210 and the head carriage control unit 208. After this, the print controller 202 drives one of the first feed unit 6A and the second feed unit 6B in accordance with the print command by using the conveyance control unit 207 and feeds the printing medium S.

<About Configuration of Ink Supply Unit for Each Ink Color>

Figure 4:
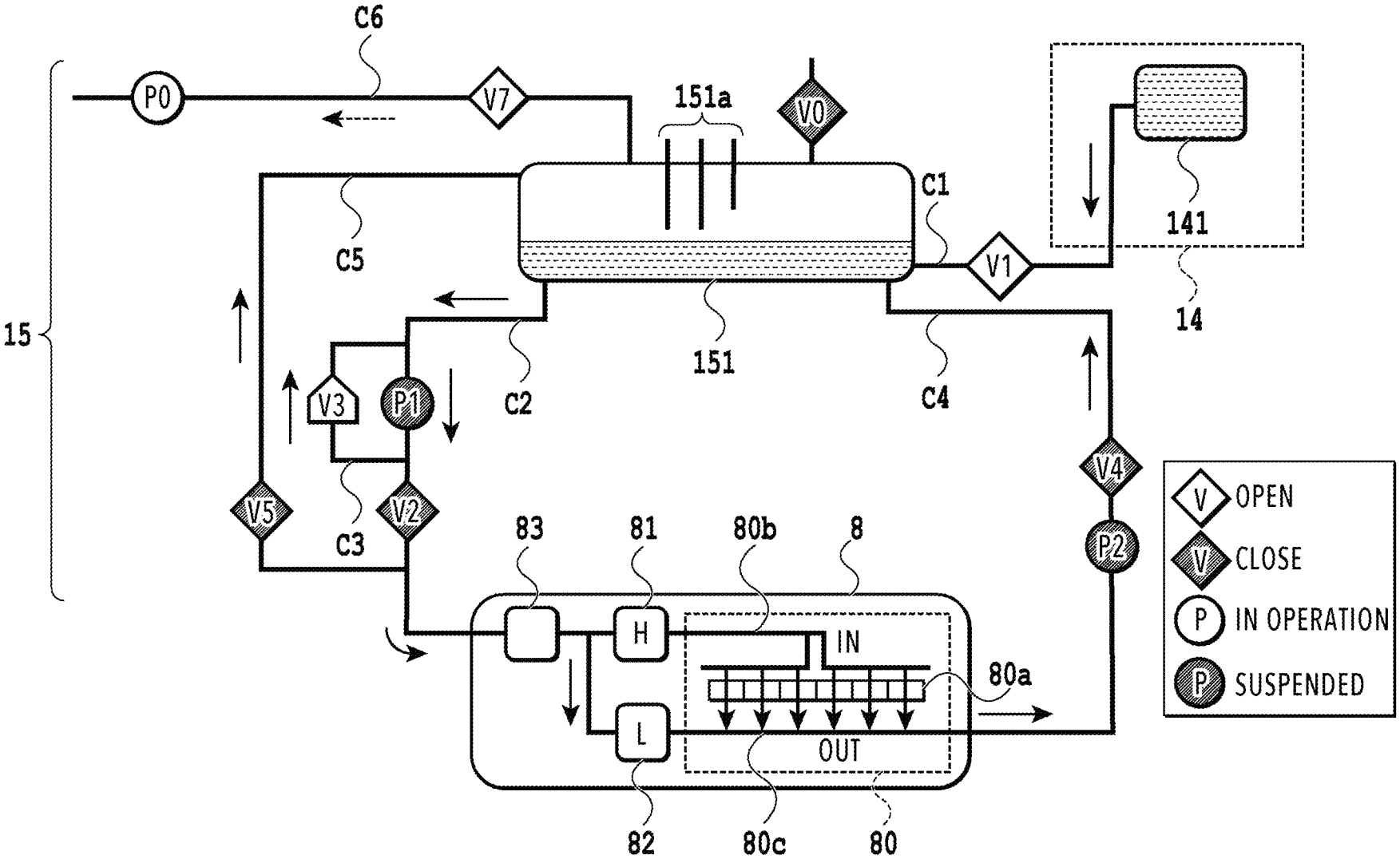
FIG. 4 is a diagram showing an ink supply unit in the first embodiment.

FIG. 4 is a diagram including the ink supply unit 15 adopted in the ink jet printing apparatus 1 of the present embodiment. By using FIG. 4, the flow path configuration of the ink circulation system of the present embodiment is explained. The ink supply unit 15 has a configuration in which ink is supplied to the print head 8 from the ink tank unit 14. Here, the configuration of one color ink is shown, but actually, such a configuration is prepared for each ink color (specifically, each color of cyan (C), magenta (M), yellow (Y), black (Bk)). The ink supply unit 15 is controlled basically by the ink supply control unit 209 shown in FIG. 2. In the following, each configuration of the unit is explained.

Ink circulates mainly between a sub tank 151 and the print head 8 (head unit in FIG. 4). In the head unit 8, the ejection operation of ink is performed based on image data and the ink not ejected is recovered again to the sub tank 151.

The sub tank 151 that stores a predetermined amount of ink is connected to a supply flow path C2 for supplying ink to the head unit 8 and a recovery flow path C4 for recovering ink from the head unit 8. That is, the circulation path through which ink circulates is configured by the sub tank 151, the supply flow path C2, the head unit 8, and the recovery flow path 4.

In the sub tank 151, a liquid surface detection unit 151*a* including a plurality of pins is provided and it is possible for the ink supply control unit 209 to grasp the height of the ink liquid surface, that is, the ink remaining amount within the sub tank 151 by detecting whether or not there is a conduction current between the plurality of pins. A decompression pump P0 is a negative pressure generation source for decompressing the inside of the sub tank 151. A decompression valve V7 is provided on the way in a flow path C6 and is a valve for switching between opening and closing of the flow path C6. An atmosphere release valve V0 is a valve for switching whether or not to cause the inside of the sub tank 151 to communicate with the atmosphere.

A main tank 141 is a tank storing ink that is supplied to the sub tank 151. The main tank 141 is configured by a flexible member and the sub tank 151 is filled with ink by a change in volume of the flexible member. The main tank 141 has a configuration attachable to and detachable from the printing apparatus main body. On the way of a tank connection flow path C1 that connects the sub tank 151 and the main tank 141, a tank supply valve V1 for switching connections of the sub tank 151 and the main tank 141 is arranged. The tank supply valve V1 is an electric drive valve.

With the above configuration, in a case of detecting that the ink within the sub tank 151 becomes smaller than a predetermined amount by the liquid surface detection unit 151*a*, the ink supply control unit 209 closes the atmosphere release valve V0, a supply valve V2, a recovery valve V4, and a head exchange valve V5. Further, the ink supply control unit 209 opens the tank supply valve V1 and the decompression valve V7. In this state, the ink supply control unit 209 causes the decompression pump P0 to operate. Then, the pressure inside the sub tank 151 becomes negative and ink is supplied from the main tank 141 to the sub tank 151. In a case of detecting that the ink within the sub tank 151 exceeds a predetermined amount by the liquid surface detection unit 151*a*, the ink supply control unit 209 closes the tank supply valve V1 and suspends the decompression pump P0.

The supply flow path C2 is a flow path for supplying ink from the sub tank 151 to the head unit 8 and on the way thereof, a supply pump P1 and the supply valve V2 are arranged. During the printing operation, by driving the supply pump P1 in the state where the supply valve V2 is open, it is possible to circulate ink in the circulation path while supplying ink to the head unit 8. The amount of ink ejected per unit time by the head unit 8 fluctuates in accordance with image data. The amount of flow of the supply pump P1 is determined so as to be compatible also with a case where the head unit 8 performs the ejection operation that maximizes the amount of ink to be ejected per unit time.

A relief flow path C3 is a flow path that is located on the upstream side of the supply valve V2 and which connects the upstream side and the downstream side of the supply pump P1. On the way of the relief flow path C3, a relief valve V3, which is a differential pressure valve, is arranged. In a case where the ink supply amount per unit time from the supply pump P1 is larger than the total value of the ejection amount per unit time of the head unit 8 and the flow amount (amount of ink to be drawn) per unit time in the recovery pump P2, the relief valve V3 is opened in accordance with the pressure that is exerted on the relief valve V3 itself. Due to this, a circulation flow path configured by a part of the supply flow path C2 and the relief flow path C3 is formed. By providing the configuration of the above-described relief flow path C3, the ink supply amount for the head unit 8 is adjusted in accordance with the ink ejection amount in the head unit 8, and therefore, it is possible to stabilize the flow pressure within the circulation path irrespective of image data.

The recovery flow path C4 is a flow path for recovering ink from the head unit 8 to the sub tank 151 and on the way thereof, a recovery pump P2 and the recovery valve V4 are arranged. At the time of circulating ink within the circulation path, the recovery pump P2 functions as a negative pressure generation source to suck ink from the head unit 8. By the drive of the recovery pump P2, an appropriate pressure difference arises between an IN flow path 80*b* and an OUT flow path 80*c* within the head unit 8, and therefore, it is possible to circulate ink between the IN flow path 80*b* and the OUT flow path 80*c*. The flow path configuration within the head unit 8 will be described later in detail.

The recovery valve V4 is a valve for checking a backflow in a case where the printing operation is not being performed, that is, ink is not being circulated within the circulation path. In the circulation path of the present embodiment, the sub tank 151 is arranged above the head unit 8 in the vertical direction (see FIG. 1). Because of this, in a case where the supply pump P1 and the recovery pump P2 are not driven, there is a possibility that ink flows backward from the sub tank 151 to the head unit 8 due to a water head difference between the sub tank 151 and the head unit 8. In order to check such a backflow, in the present embodiment, the recovery valve V4 is provided in the recovery flow path C4.

Similarly, the supply valve V2 also functions as a valve for preventing supply of ink from the sub tank 151 to the head unit 8 in a case where the printing operation is not being performed, that is, ink is not being circulated within the circulation path.

A head exchange flow path C5 is a flow path that connects the supply flow path C2 and an air chamber of the sub tank 151 and on the way thereof, the head exchange valve V5 is arranged. One end of the head exchange flow path C5 is connected to the upstream of the head unit 8 in the supply flow path C2 and the other end is connected to the upper portion of the sub tank 151 and communicates with the air chamber inside thereof. The head exchange flow path C5 is made use of for recovering ink from the head unit 8 in use, such as at the time of exchanging the head unit 8 or transporting the printing apparatus 1. The head exchange valve V5 is controlled by the ink supply control unit 209 so as to close except for a case where the printing apparatus 1 is initially filled with ink and a case where ink is recovered from the head unit 8. Further, the above-described supply valve V2 is provided between the connection portion with the head exchange flow path C5 and the connection portion with the relief flow path C3 in the supply flow path C2.

Next, the flow path configuration within the head unit 8 is explained. The ink supplied to the head unit 8 by the supply flow path C2 is supplied to a first negative pressure control unit 81 and a second negative pressure control unit 82 after passing a filter 83. The control pressure of the first negative pressure control unit 81 is set to a weak negative pressure. The control pressure of the second negative pressure control unit 82 is set to a strong negative pressure. The pressures in the first negative pressure control unit 81 and the second negative pressure control unit 82 are generated in an appropriate range by the drive of the recovery pump P2.

In an ink ejection unit 80, a plurality of printing element substrates 80*a* on which a plurality of ejection ports is arrayed is arranged and a long ejection port row is formed. The common supply flow path 80*b* (IN flow path) for guiding ink supplied by the first negative pressure control unit 81 and the common recovery flow path 80*c* (OUT flow path) for guiding ink supplied by the second negative pressure control unit 82 also extend in the array direction of the printing element substrate 80*a*. Further, on the individual printing element substrate 80*a*, an individual supply flow path connected with the common supply flow path 80*b* and an individual recovery flow path connected with the common recovery flow path 80*c* are formed. Because of this, on the individual printing element substrate 80*a*, a flow of ink is generated, which flows in from the common supply flow path 80*b* where the negative pressure is relatively weak and flows out to the common recovery flow path 80*c* where the negative pressure is relatively strong. In the path between the individual supply flow path and the individual recovery flow path, a pressure chamber that communicates with each ejection port and which fills ink is provided and also in the ejection port or the pressure chamber not performing printing, a flow of ink is generated. In a case where the ejection operation is performed on the printing element substrate 80*a*, a part of the ink that moves from the common supply flow path 80*b* to the common recovery flow path 80*c* is discharged by being ejected from the ejection port, but the ink that is not ejected moves to the recovery flow path C4 via the common recovery flow path 80*c*.

With the above configuration, in a case where the printing operation is performed, the ink supply control unit 209 closes the tank supply valve V1, the head exchange valve V5, and the decompression valve V7, opens the atmosphere release valve V0, the supply valve V2, and the recovery valve V4, and drives the supply pump P1 and the recovery pump P2. Due to this, a circulation path of the sub tank 151 the supply flow path C2 the head unit 8 the recovery flow path C4 the sub tank 151 is established. In a case where the ink supply amount per unit time from the supply pump P1 is larger than the total value of the ejection amount per unit time of the head unit 8 and the flow amount per unit time in the recovery pump P2, ink flows into the relief flow path C3 from the supply flow path C2. Due to this, the flow amount of the ink that flows into the head unit 8 from the supply flow path C2 is adjusted.

In a case where the printing operation is not being performed, the ink supply control unit 209 suspends the supply pump P1 and the recovery pump P2 and closes the atmosphere release valve V0, the supply valve V2, and the recovery valve V4. Due to this, the flow of ink within the head unit 8 suspends and a backflow due to the water head difference between the sub tank 151 and the head unit 8 is suppressed. Further, by closing the atmosphere release valve V0, leakage of ink and evaporation of ink from the sub tank 151 are suppressed.

In a case where ink is recovered from the head unit 8, the ink supply control unit 209 closes the atmosphere release valve V0, the tank supply valve V1, the supply valve V2, and the recovery valve 4, opens the head exchange valve V5 and the decompression valve V7, and drives the decompression pump P0. Due to this, the inside of the sub tank 151 enters a negative pressure state and the ink within the head unit 8 is recovered to the sub tank 151 via the head exchange flow path C5. As described above, the head exchange valve V5 is a valve that is closed at the time of the normal printing operation and the standby and opened at the time of recovering ink from the head unit 8. However, the head exchange valve V5 is also opened at the time of filling the head exchange flow path C5 with ink in a case where the head unit 8 is filled initially.

<About Processing to Replenish Sub Tank with Ink from Main Tank (in Case of One Color)>

In the following, the processing to replenish the sub tank 151 with ink in the configuration shown in FIG. 4 (that is, processing to replenish the sub tank with ink regarding arbitrary one color ink of the four colors of CMYBk) is explained by using FIG. 5. The ink replenishment processing described in the following starts in the state where circulation of ink is suspended within the above-described circulation path. Specifically, the state where the decompression pump P0, the supply pump P1, and the recovery pump P2 are suspended and the atmosphere release valve V0, the tank supply valve V1, the supply valve V2, the recovery valve V4, the head exchange valve V5, and the decompression valve V7 are closed.

At S501, the print controller 202 opens the decompression valve V7 by controlling the ink supply control unit 209.

At S502, the print controller 202 opens the tank supply valve V1 by controlling the ink supply control unit 209. By this step, the preparation for supply of ink from the main tank 141 to the sub tank 151 is completed.

At S503, the print controller 202 drives the decompression pump P0 by controlling the ink supply control unit 209. By this step, the pressure within the sub tank 151 becomes negative, and therefore, ink is drawn into the sub tank 151 from the main tank 141

After this, in a case of detecting that the sub tank 151 is filled with a predetermined amount of ink by using the liquid surface detection unit 151*a*, the print controller 202 suspends the decompression pump P0 by controlling the ink supply control unit 209 at S504.

At S505, the print controller 202 opens the atmosphere release valve V0 by controlling the ink supply control unit 209. By this step, the inside of the sub tank 151 is opened to the atmosphere.

At S506, the print controller 202 closes the atmosphere release valve V0 by controlling the ink supply control unit 209. By performing the processing at S504 to S506, the ink flow from the main tank 141 to the sub tank 151 is suspended. The above is the contents of the processing to replenish the sub tank 151 with ink from the main tank 141 regarding arbitrary one color ink.

<About Configuration of Ink Supply Unit for a Plurality of Ink Colors>

As described above, the ink supply unit of the printing apparatus 1 includes the ink supply unit for each ink color (specifically, the ink supply unit of C, the ink supply unit of M, the ink supply unit of Y, and the ink supply unit of Bk). Each of these ink supply units has the same configuration as that of the ink supply unit 15 shown in FIG. 4.

That is, the ink supply unit of each color includes the main tank 141, the sub tank 151, the tank supply valve V1 that switches between opening and closing of the flow path C1 between the main tank 141 and the sub tank 151, and the atmosphere release valve V0 for each color. However, in the present embodiment, the decompression pump P0 and the decompression valve V7 that switches between opening and closing of the flow path C6 connecting the decompression pump P0 and the sub tank 151 are not provided for each color but are used in common by all the colors of CMYBk.

Figure 6:
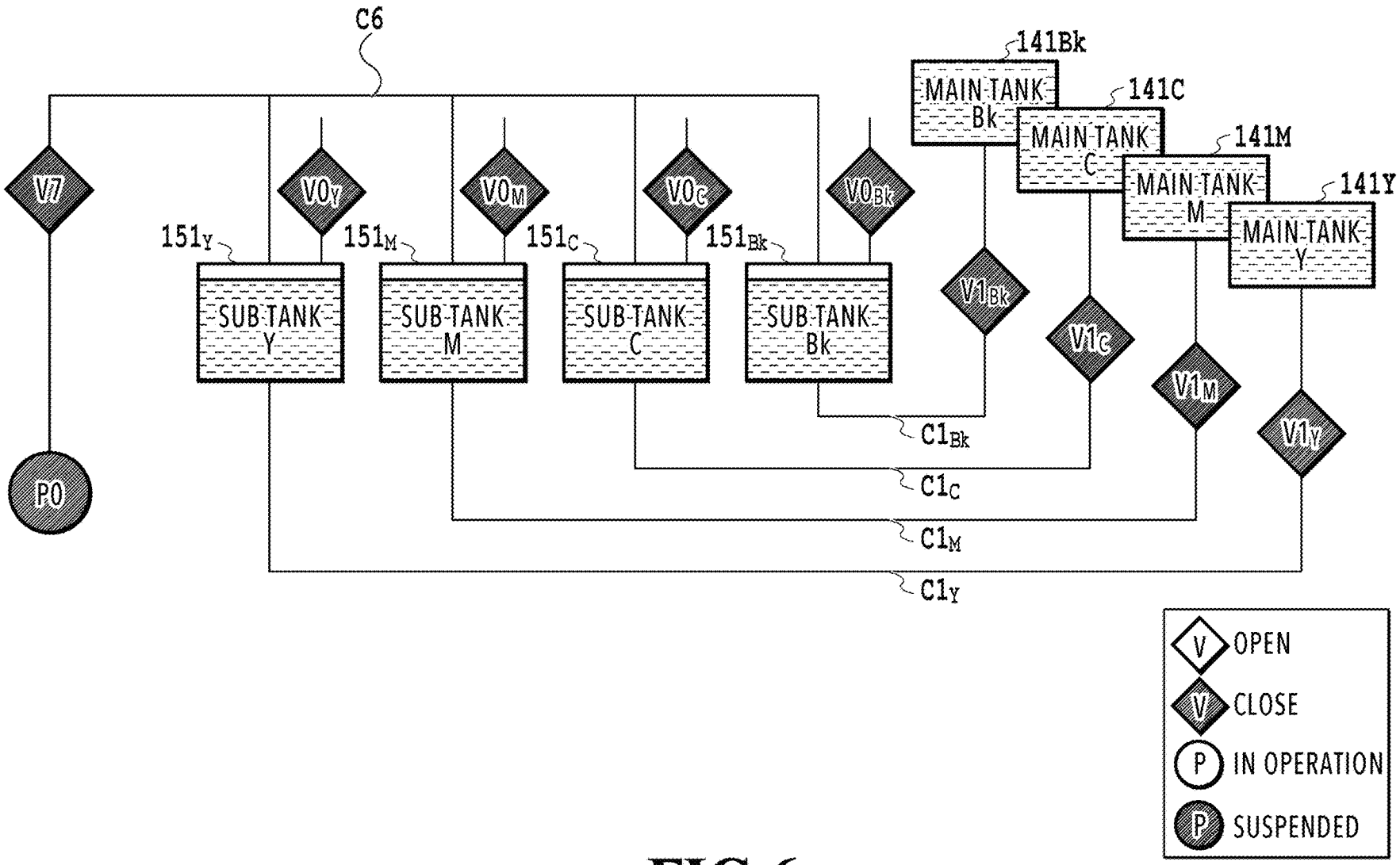
FIG. 6 is an outline diagram of the ink supply unit in the first embodiment.

FIG. 6 is an outline diagram of the ink supply unit in the above-described present embodiment. For example, as for Bk, the ink supply unit of Bk includes the main tank $\mathbf{141}_{Bk}$, the sub tank $\mathbf{151}_{Bk}$, the flow path $\mathbf{C1}_{Bk}$ that connects the main tank $\mathbf{141}_{Bk}$ and the sub tank $\mathbf{151}_{Bk}$, the tank supply valve $\mathbf{V1}_{Bk}$, and the atmosphere release valve $\mathbf{V0}_{Bk}$. The ink supply units of the other colors have the same configuration as that of the ink supply unit of Bk. The air flow path of the ink supply unit of each color is integrated with the one flow path C6 and in the flow path C6 integrating the air flow path, the decompression valve V7 and the decompression pump P0 are arranged.

<About Drive Mechanism of Tank Supply Valve>

In the following, a mechanism (called tank supply valve drive mechanism) for driving the tank supply valves $\mathbf{V1}_C$, $\mathbf{V1}_M$, $\mathbf{V1}_Y$, and $\mathbf{V1}_{Bk}$ of each color is explained by using FIG. 7. As shown schematically, a tank supply valve drive mechanism 700 includes a motor 701, a gear train 702, a shaft 703, and cams $\mathbf{704}_C$, $\mathbf{704}_M$, $\mathbf{704}_Y$, and $\mathbf{704}_{Bk}$ corresponding to each color.

Figure 7:
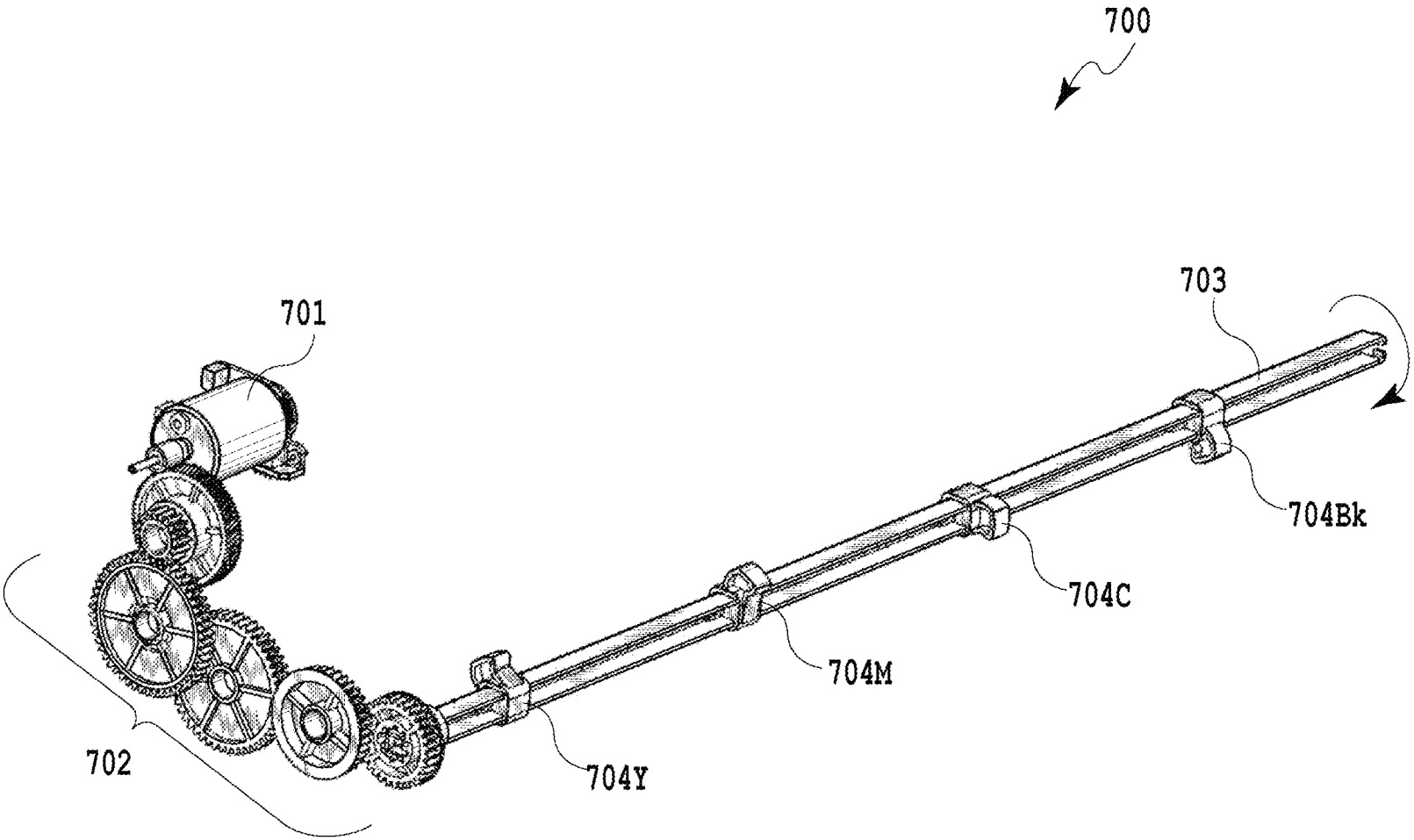
FIG. 7 is a diagram showing a drive mechanism of tank supply valves in the first embodiment.

The force generated by the motor 701, which is a drive source, is transmitted to the shaft 703 via the gear train 702 and rotates the shaft 703 in an arrow direction in FIG. 7 (this direction is defined as the normal rotation direction or the forward direction). At different positions in the lengthwise direction of the shaft 703, the cams $\mathbf{704}_C$, $\mathbf{704}_M$, $\mathbf{704}_Y$, and $\mathbf{704}_{Bk}$ for opening and closing the tank supply valves $\mathbf{V1}_C$, $\mathbf{V1}_M$, $\mathbf{V1}_Y$, and $\mathbf{V1}_{Bk}$ of each color are provided. In a case where one of the four cams faces downward, the tank supply valve of the color corresponding to the cam opens. In the state of the drive mechanism shown in FIG. 7, the cam $\mathbf{704}_{Bk}$ of Bk faces downward, and therefore, the tank supply valve $\mathbf{V1}_{Bk}$ opens and on the other hand, the tank supply valves $\mathbf{V1}_C$, $\mathbf{V1}_M$, and $\mathbf{V1}_Y$ remain in the closed state.

In a case of rotating the shaft 703 by a predetermined angle (in case of FIG. 7, 90 degrees) in the normal rotation direction from the state shown in FIG. 7, the cam $\mathbf{704}_{Bk}$ of Bk no longer faces downward, and therefore, the tank supply valve $\mathbf{V1}_{Bk}$ closes and the tank supply valve $\mathbf{V1}_{C}$ opens because the cam $\mathbf{704}_{C}$ of C faces downward. In a case of further rotating the shaft 703 by a predetermined angle in the normal rotation direction after this, the cam $\mathbf{704}_{C}$ of C no longer faces downward, and therefore, the tank supply valve $\mathbf{V1}_{C}$ closes and the tank supply valve $\mathbf{V1}_{M}$ opens because the cam $\mathbf{704}_{M}$ of M faces downward. In a case of still further rotating the shaft 703 by a predetermined angle in the normal rotation direction after this, the cam $\mathbf{704}_{M}$ of M no longer faces downward, and therefore, the tank supply valve $\mathbf{V1}_{M}$ closes and the tank supply valve $\mathbf{V1}_{Y}$ opens because the cam $\mathbf{704}_{Y}$ of Y faces downward. As described above, in the present embodiment, in a case where the shaft 703 rotates in the normal rotation direction, each cam opens the tank supply valve of the corresponding ink color at different rotation angles. Due to the configuration such as this, the tank supply valve of each color opens in predetermined color order (in this example, in order of $\mathbf{V1}_{Bk}\rightarrow\mathbf{V1}_{C}\rightarrow\mathbf{V1}_{M}\rightarrow\mathbf{V1}_{Y}$).

<About Case where it Becomes Necessary to Open Inside of Sub Tank to Atmosphere at the Time of Switching Between Opening and Closing of Tank Supply Valve>

Figure 8:
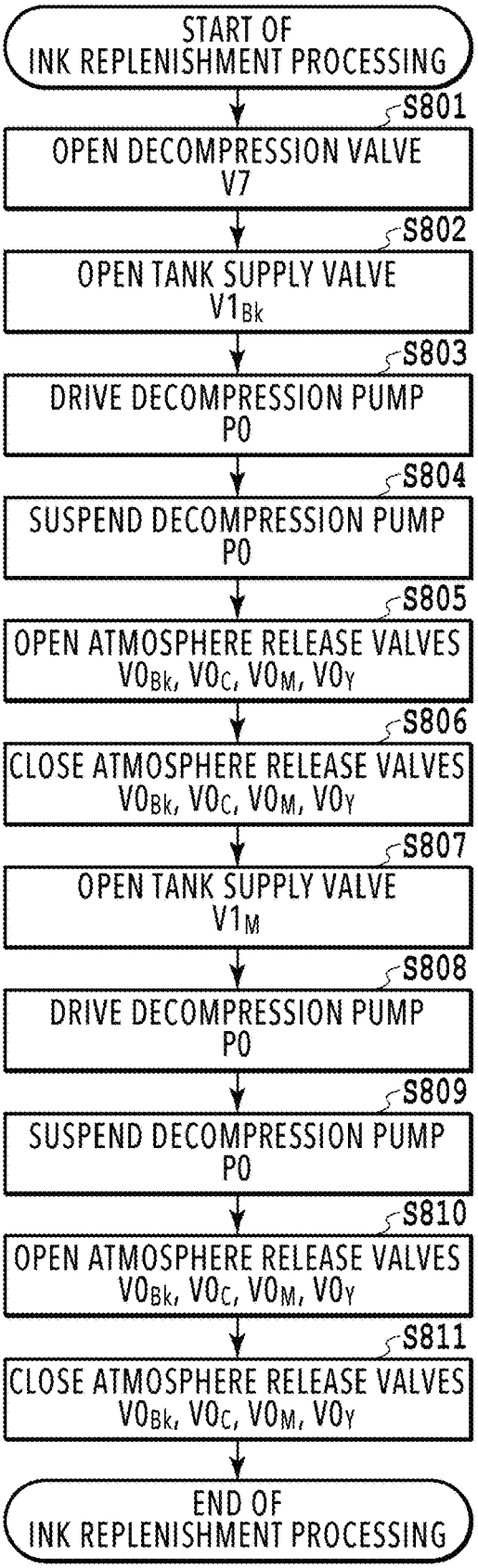
FIG. 8 is a flowchart of ink replenishment processing in the first embodiment.

In the following, a case where it becomes necessary to open the inside of the sub tank to the atmosphere at the time of switching between opening and closing of the tank supply valve for replenishing the sub tank of each color with ink is explained by taking a case where the sub tanks are replenished with the Bk ink and the M ink, respectively, as an example. FIG. 8 is a flowchart of processing to replenish the sub tank $\mathbf{151}_{Bk}$ and the sub tank $\mathbf{151}_{M}$ with ink in the ink supply unit shown in FIG. 6. The ink replenishment processing shown below starts in the state where circulation of ink is suspended within the above-described circulation path. Specifically, the state where the decompression pump P0, the supply pump P1, and the recovery pump P2 are suspended and the atmosphere release valve V0, the tank supply valve V1, the supply valve V2, the recovery valve V4, the head exchange valve V5, and the decompression valve V7 are closed.

At S801, the print controller 202 opens the decompression valve V7 by controlling the ink supply control unit 209.

At S802, the print controller 202 opens the tank supply valve $\mathbf{V1}_{Bk}$ by controlling the ink supply control unit 209. By this step, the preparation for supply of the Bk ink from the main tank $\mathbf{141}_{Bk}$ to the sub tank $\mathbf{151}_{Bk}$ is completed.

Figure 9A:
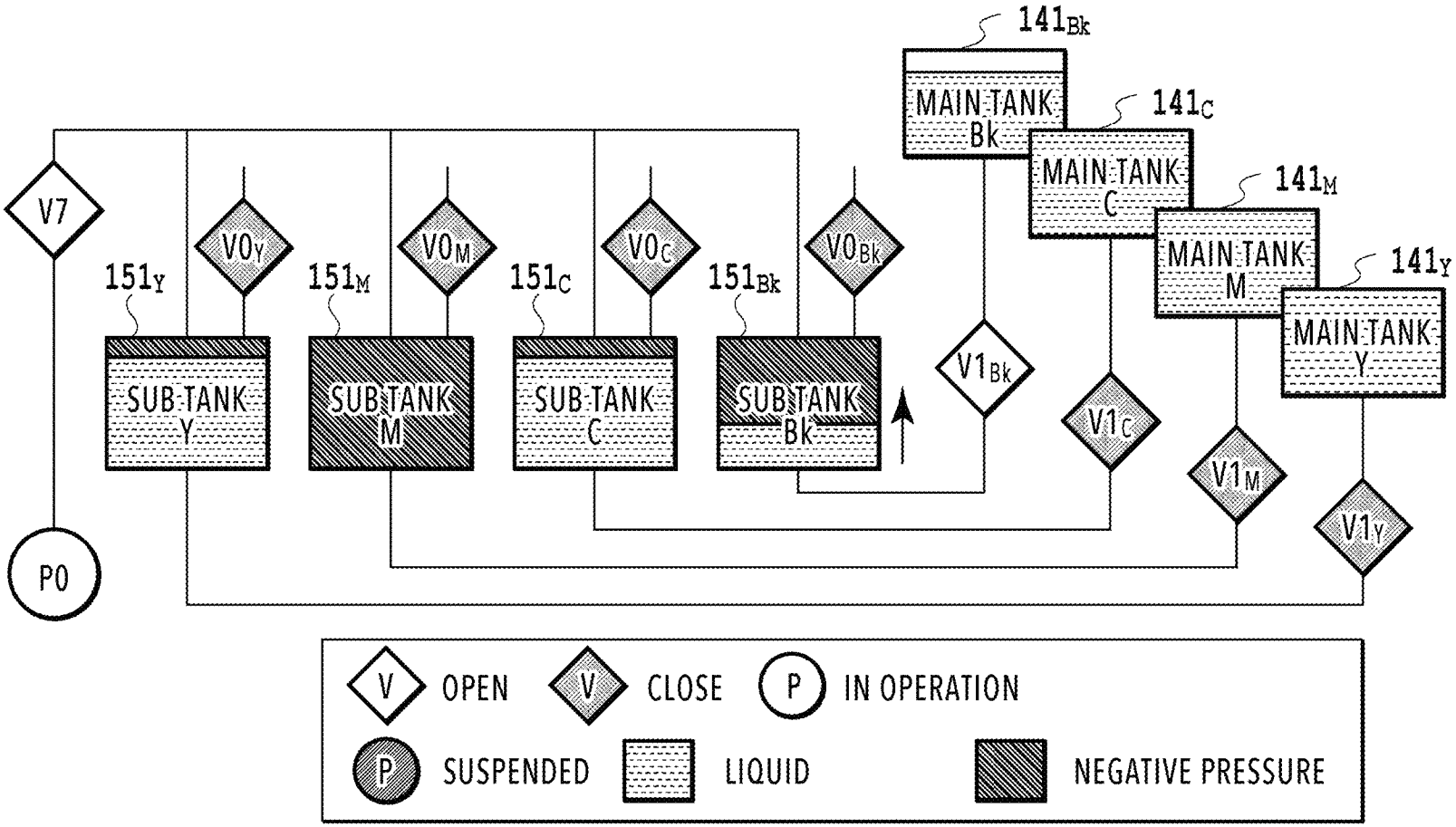
FIG. 9A to FIG. 9C are diagrams showing an aspect in which replenishment of a Bk ink and an M ink is performed in the first embodiment.

At S803, the print controller 202 drives the decompression pump P0 by controlling the ink supply control unit 209. By this step, the pressure within all the sub tanks including the sub tank $\mathbf{151}_{Bk}$ becomes negative at the same time and the Bk ink is drawn into the sub tank $\mathbf{151}_{Bk}$ from the main tank $\mathbf{141}_{Bk}$ as shown in FIG. 9A.

After this, in a case of detecting that the sub tank $\mathbf{151}_{Bk}$ is filled with a predetermined amount of Bk ink by using the liquid surface detection unit 151*a*, the print controller 202 suspends the decompression pump P0 by controlling the ink supply control unit 209 at S804.

Figure 9B:
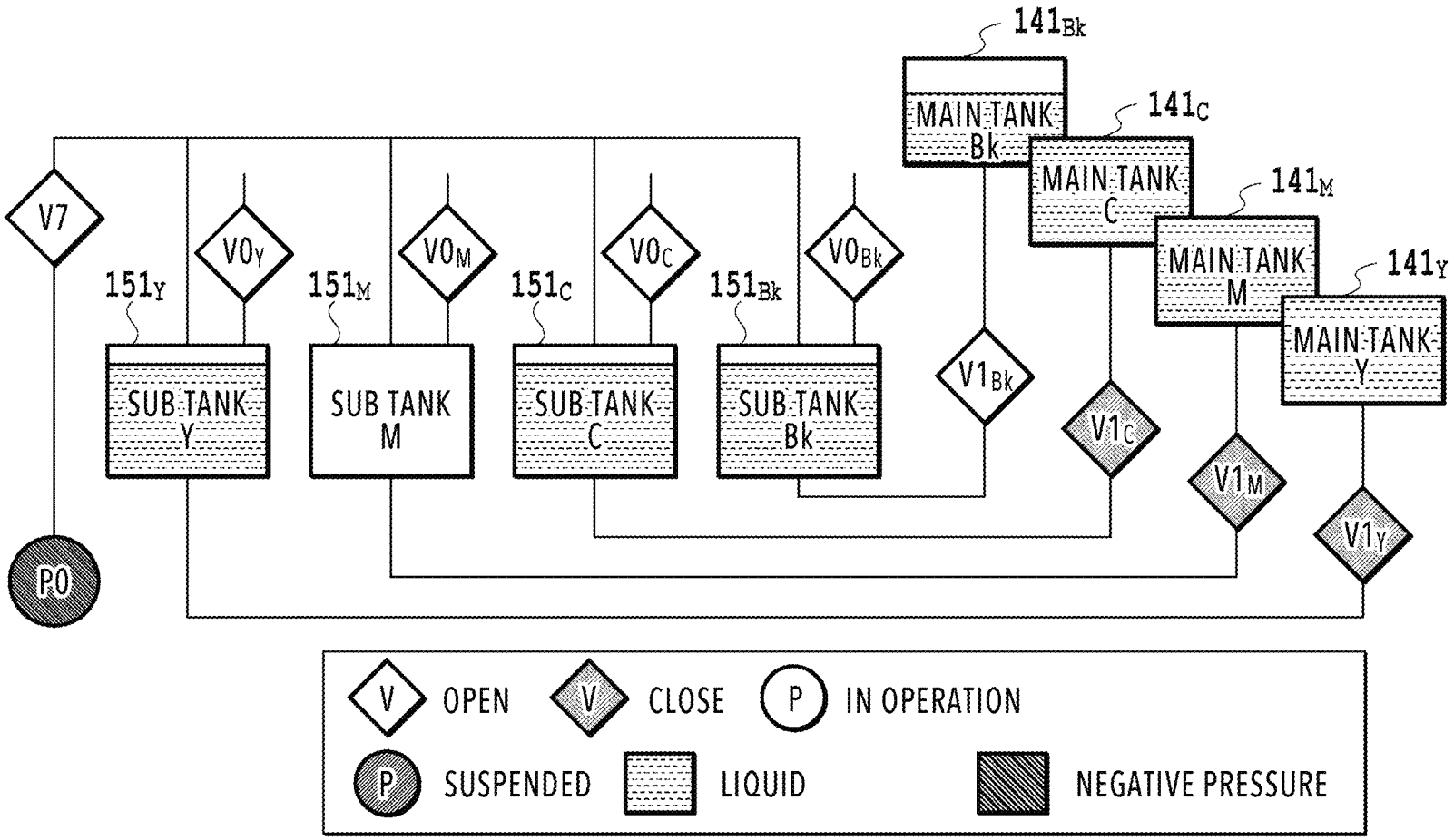

After this, the print controller 202 determines whether the ink that is replenished next is the ink for which the tank supply valve enters the open state next to the ink replenished immediately before. That is, in this example, whether the ink that is replenished next is the C ink for which the tank supply valve enters the open state next to the Bk ink is determined. In a case where the determination results are negative, at S805, the print controller 202 opens the atmosphere release valves $\mathbf{V0}_{C}$, $\mathbf{V0}_{M}$, $\mathbf{V0}_{Y}$, and $\mathbf{V0}_{Bk}$ by controlling the ink supply control unit 209. After this step, the ink supply unit 15 enters the state shown in FIG. 9B. The reason the atmosphere release valve is opened at S805 is as follows.

As described above, in the present embodiment, the decompression pump P0 and the decompression valve V7 are not provided for each color but are used in common by all the colors of CMYBk. In this aspect, after the decompression pump P0 is suspended at S804, the state is maintained where the pressure within the sub tanks $\mathbf{151}_{C}$, $\mathbf{151}_{M}$, $\mathbf{151}_{Y}$, and $\mathbf{151}_{Bk}$ of each color is negative. Further, in the present embodiment, the tank supply valve for each color opens in predetermined color order (specifically, in order of $\mathbf{V1}_{Bk}\rightarrow\mathbf{V1}_{C}\rightarrow\mathbf{V1}_{M}\rightarrow\mathbf{V1}_{Y}$), and therefore, in a case where the state is changed from the state where the tank supply valve $\mathbf{V1}_{Bk}$ is open into the state where the tank supply valve $\mathbf{V1}_{M}$ is open, the state where the tank supply valve $\mathbf{V1}_{C}$ is open is interposed. Because of this, in a case where the state where the pressure within the sub tank $\mathbf{151}_{C}$ is negative is maintained, the C ink is drawn into the sub tank $\mathbf{151}_{C}$ that does not need replenishment from the main tank $\mathbf{141}_{C}$. As a result of this, there is a possibility that the C ink overflows from the sub tank $\mathbf{151}_{C}$.

Consequently, by opening the atmosphere release valve $\mathbf{V0}_{C}$ at S805 for the purpose of preventing such a case, the negative pressure within the sub tank $\mathbf{151}_{C}$ is cancelled. Due to this, even in a configuration in which the tank supply valve $\mathbf{V1}_{C}$ temporarily opens in a case where the state is changed from the state where the tank supply valve $\mathbf{V1}_{Bk}$ is open into the state where the tank supply valve $\mathbf{V1}_{M}$ is open, the C ink is not supplied to (drawn into) the sub tank $\mathbf{151}_{C}$ from the main tank $\mathbf{141}_{C}$. Consequently, the C ink is prevented from overflowing from the sub tank $\mathbf{151}_{C}$.

Explanation is returned to the flow in FIG. 8. At S806, the print controller 202 closes the atmosphere release valves $\mathbf{V0}_{C}$, $\mathbf{V0}_{M}$, $\mathbf{V0}_{Y}$, and $\mathbf{V0}_{Bk}$ by controlling the ink supply control unit 209.

At S807, the print controller 202 opens the tank supply valve $\mathbf{V1}_{M}$ by controlling the ink supply control unit 209. By this step, the preparation for supply of the M ink from the main tank $\mathbf{141}_{M}$ to the sub tank $\mathbf{151}_{M}$ is completed.

Figure 9C:
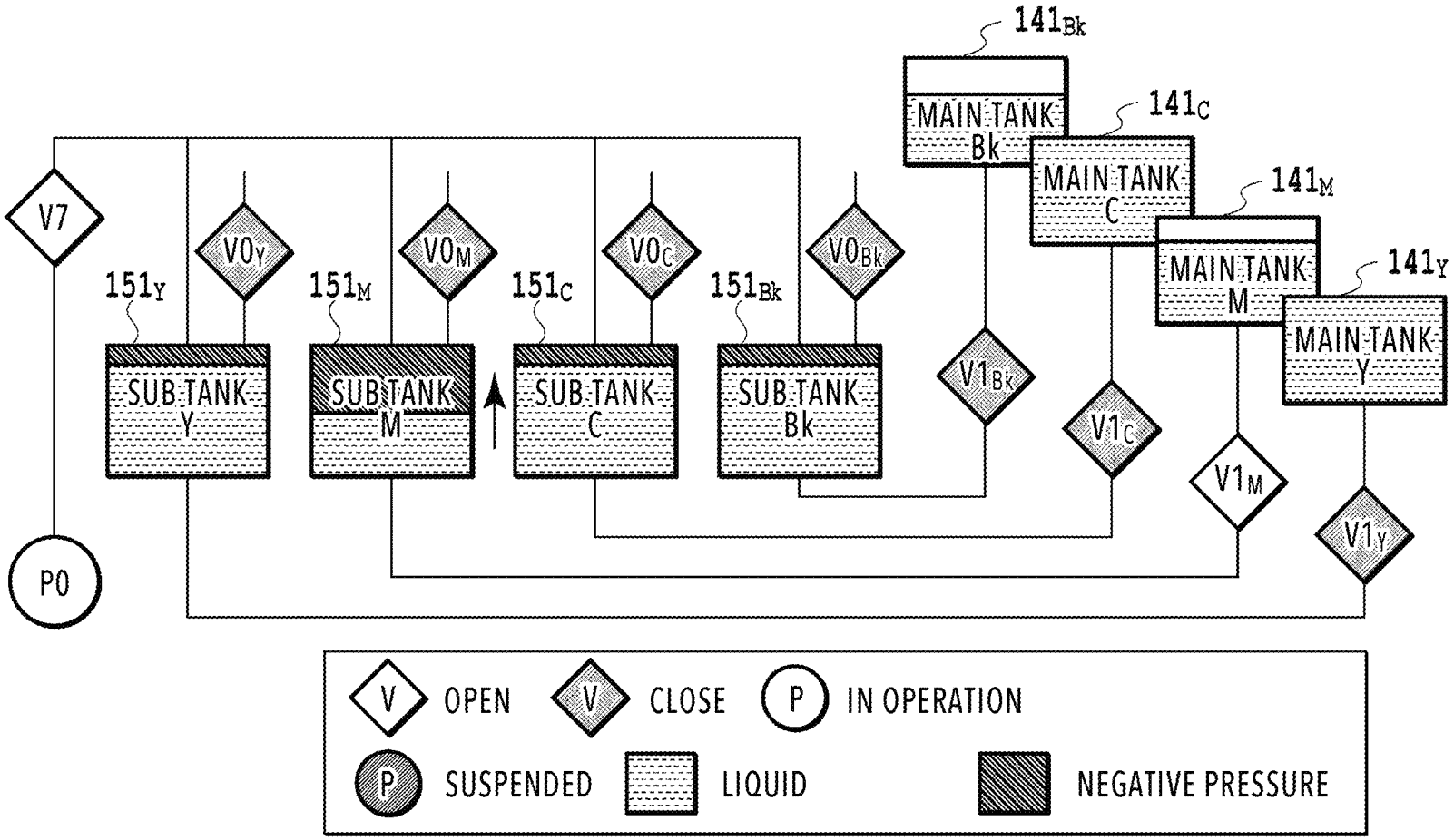

At S808, the print controller 202 drives the decompression pump P0 by controlling the ink supply control unit 209. By this step, as shown in FIG. 9C, the M ink is drawn into the sub tank $\mathbf{151}_{M}$ from the main tank $\mathbf{141}_{M}$.

After this, in a case of detecting that the sub tank $\mathbf{151}_{M}$ is filled with a predetermined amount of the M ink by using the liquid surface detection unit 151*a*, the print controller 202 suspends the decompression pump P0 by controlling the ink supply control unit 209 at S809.

At step S810, the print controller 202 opens the atmosphere release valves $\mathbf{V0}_{Bk}$, $\mathbf{V0}_{C}$, $\mathbf{V0}_{M}$, and $\mathbf{V0}_{Y}$ by controlling the ink supply control unit 209.

At step S811, the print controller 202 closes the atmosphere release valves $\mathbf{V0}_{Bk}$, $\mathbf{V0}_{C}$, $\mathbf{V0}_{M}$, and $\mathbf{V0}_{Y}$ by controlling the ink supply control unit 209. The above is the contents of the ink replenishment processing in a case of replenishment of the Bk ink and the M ink in the present embodiment.

<About Case where it is not Necessary to Open Inside of Sub Tank to Atmosphere at the Time of Switching Between Opening and Closing of Tank Supply Valve>

Figure 10:
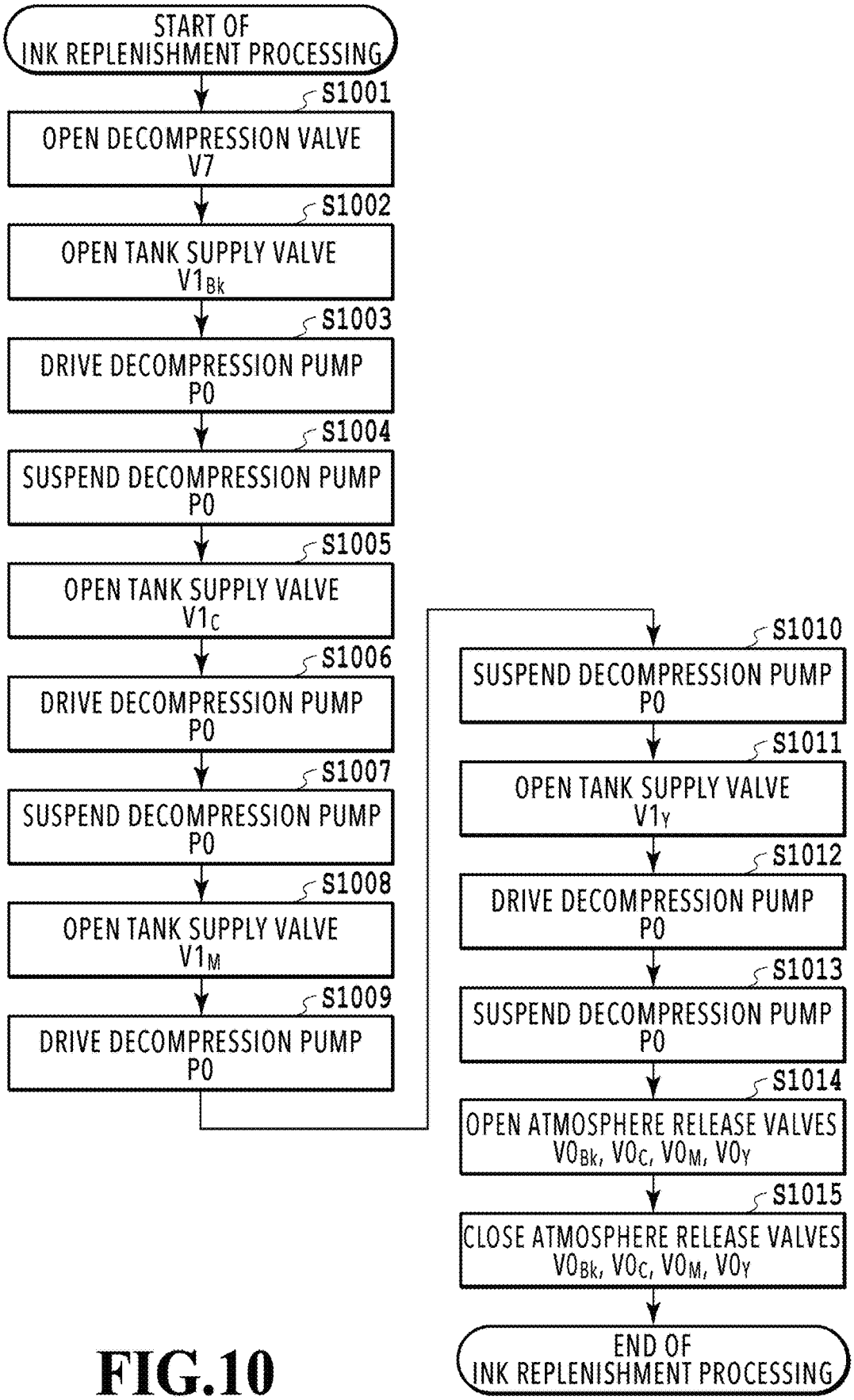
FIG. 10 is a flowchart of ink replenishment processing in the first embodiment.

In the following, for a comparison, a case where it is not necessary to open the inside of a sub tank to the atmosphere at the time of switching between opening and closing of a tank supply valve in replenishing the sub tank of each color with ink is explained by taking a case where each sub tank is replenished with the Bk ink, the C ink, the M ink, and the Y ink, respectively, as an example. FIG. 10 is a flowchart of processing to replenish the sub tank $\mathbf{151}_{Bk}$, the sub tank $\mathbf{151}_{C}$, the sub tank $\mathbf{151}_{M}$, and the sub tank $\mathbf{151}_{Y}$ with ink in the ink supply unit shown in FIG. 6. The ink replenishment processing shown below starts in the state where circulation of ink is suspended within the above-described circulation path. Specifically, the state where the decompression pump P0, the supply pump P1, and the recovery pump P2 are suspended and the atmosphere release valve V0, the tank supply valve V1, the supply valve V2, the recovery valve V4, the head exchange valve V5, and the decompression valve V7 are closed.

At S1001, the print controller 202 opens the decompression valve V7 by controlling the ink supply control unit 209.

At S1002, the print controller 202 opens the tank supply valve $\mathbf{V1}_{Bk}$ by controlling the ink supply control unit 209. By this step, the preparation for supply of the Bk ink from the main tank $\mathbf{141}_{Bk}$ to the sub tank $\mathbf{151}_{Bk}$ is completed.

At S1003, the print controller 202 drives the decompression pump P0 by controlling the ink supply control unit 209. By this step, the pressure inside the sub tank $\mathbf{151}_{Bk}$ becomes negative and the Bk ink is drawn into the sub tank $\mathbf{151}_{Bk}$ from the main tank $\mathbf{141}_{Bk}$.

After this, in a case of detecting that the sub tank $\mathbf{151}_{Bk}$ is filled with a predetermined amount of the Bk ink by using the liquid surface detection unit 151*a*, the print controller 202 suspends the decompression pump P0 by controlling the ink supply control unit 209 at S1004.

At S1005, the print controller 202 opens the tank supply valve $\mathbf{V1}_{C}$ by controlling the ink supply control unit 209. By this step, the preparation for supply of the C ink from the main tank $\mathbf{141}_{C}$ to the sub tank $\mathbf{151}_{C}$ is completed. After the completion of this step, the negative pressure within the sub tank $\mathbf{151}_{C}$ is maintained, and therefore, the C ink is drawn into the sub tank $\mathbf{151}_{C}$ from the main tank $\mathbf{141}_{C}$, but no problem arises because the sub tank $\mathbf{151}_{C}$ is the replenishment target.

At S1006, the print controller 202 drives the decompression pump P0 by controlling the ink supply control unit 209. By this step, the C ink is drawn into the sub tank $\mathbf{151}_{C}$ from the main tank $\mathbf{141}_{C}$.

After this, in a case of detecting that the sub tank $\mathbf{151}_{C}$ is filled with a predetermined amount of the C ink by using the liquid surface detection unit 151*a*, the print controller 202 suspends the decompression pump P0 by controlling the ink supply control unit 209 at S1007.

At S1008, the print controller 202 opens the tank supply valve $\mathbf{V1}_{M}$ by controlling the ink supply control unit 209. By this step, the preparation for supply of the M ink from the main tank $\mathbf{141}_{M}$ to the sub tank $\mathbf{151}_{M}$ is completed. After the completion of this step, the negative pressure within the sub tank $\mathbf{151}_{M}$ is maintained, and therefore, the M ink is drawn into the sub tank $\mathbf{151}_{M}$ from the main tank $\mathbf{141}_{M}$, but no problem arises because the sub tank $\mathbf{151}_{M}$ is the replenishment target.

At S1009, the print controller 202 drives the decompression pump P0 by controlling the ink supply control unit 209. By this step, the M ink is drawn into the sub tank $\mathbf{151}_{M}$ from the main tank $\mathbf{141}_{M}$.

After this, in a case of detecting that the sub tank $\mathbf{151}_{M}$ is filled with a predetermined amount of the M ink by using the liquid surface detection unit 151*a*, the print controller 202 suspends the decompression pump P0 by controlling the ink supply control unit 209 at S1010.

At S1011, the print controller 202 opens the tank supply valve $\mathbf{V1}_{Y}$ by controlling the ink supply control unit 209. By this step, the preparation for supply of the Y ink from the main tank $\mathbf{141}_{Y}$ to the sub tank $\mathbf{151}_{Y}$ is completed. After the completion of this step, the negative pressure within the sub tank $\mathbf{151}_{Y}$ is maintained, and therefore, the Y ink is drawn into the sub tank $\mathbf{151}_{Y}$ from the main tank $\mathbf{141}_{Y}$, but no problem arises because the sub tank $\mathbf{151}_{Y}$ is the replenishment target.

At S1012, the print controller 202 drives the decompression pump P0 by controlling the ink supply control unit 209. By this step, the Y ink is drawn into the sub tank $\mathbf{151}_{Y}$ from the main tank $\mathbf{141}_{Y}$.

After this, in a case of detecting that the sub tank $\mathbf{151}_{Y}$ is filled with a predetermined amount of the Y ink by using the liquid surface detection unit 151*a*, the print controller 202 suspends the decompression pump P0 by controlling the ink supply control unit 209 at S1013.

At S1014, the print controller 202 opens the atmosphere release valves $\mathbf{V0}_{Bk}$, $\mathbf{V0}_{C}$, $\mathbf{V0}_{M}$, and $\mathbf{V0}_{Y}$ by controlling the ink supply control unit 209.

At S1015, the print controller 202 closes the atmosphere release valves $\mathbf{V0}_{Bk}$, $\mathbf{V0}_{C}$, $\mathbf{V0}_{M}$, and $\mathbf{V0}_{Y}$ by controlling the ink supply control unit 209. The above is the contents of the ink replenishment processing in a case of replenishment of the Bk ink, the C ink, the M ink, and the Y ink.

As described above, in a case where the order of replenishment of the sub tanks with ink and the order of opening of the tank supply valves are the same for each color ink, it is not necessary to open the inside of the sub tank to the atmosphere before switching between opening and closing of the tank supply valve. Consequently, it is possible to reduce the time required for the ink replenishment processing.

About Effect of the Present Embodiment

As explained above, in a case where the order of replenishment of the sub tanks with ink and the order of opening of the tank supply valves are different for each color ink, the inside of the sub tank is opened to the atmosphere after the decompression pump is driven and before opening and closing of the tank supply valve are switched. Here, the sub tank whose inside is opened to the atmosphere includes the sub tank for storing the color ink that does not need replenishment and whose corresponding tank supply valve enters the open state earlier than the tank supply valve corresponding to the replenishment-target color ink.

By the present embodiment, it is possible to prevent an ink inflow to a sub tank that does not need replenishment and to prevent ink from overflowing from the sub tank.

Second Embodiment

In the first embodiment, the aspect is explained in which the inside of the sub tank is opened to the atmosphere at the time of switching between opening and closing of the tank supply valve in order to replenish the sub tank with ink for each color ink. In contrast to this, in the present embodiment, an aspect is explained in which the tank supply valve corresponding to the color ink that is replenished first is opened before the decompression pump is driven. In the following, explanation of the same contents as those of the above-described embodiment is omitted appropriately.

<About Case where Tank Supply Valve Corresponding to Color Ink that is Replenished First is Opened Before Decompression Pump is Driven>

In the following, a case where the tank supply valve corresponding to the color ink that is replenished first is opened before the decompression pump is driven is explained by taking a case where each sub tank is replenished with the M ink and the Y ink, respectively, in the ink supply unit shown in FIG. 6 as an example.

In this case, first, the print controller 202 opens the decompression valve V7 by controlling the ink supply control unit 209 and then opens the tank supply valve $V1_M$. Due to this, the preparation for supply of the M ink from the main tank $141_M$ to the sub tank $151_M$ is completed. The present embodiment adopts the same ink supply unit as that in the first embodiment and the tank supply valves open in the order of $V1_{Bk} \rightarrow V1_C \rightarrow V1_M \rightarrow V1_Y$, and therefore, the tank supply valve $V1_M$ opens after the tank supply valves $V1_{Bk}$ and $V1_C$ open.

Next, the print controller 202 drives the decompression pump P0 by controlling the ink supply control unit 209. Due to this, the M ink is drawn into the sub tank $151_M$ from the main tank $141_M$. As described above, in the present embodiment, the decompression pump P0 is driven for the first time after opening the tank supply valve $V1_M$, and therefore, at the timing at which the tank supply valves $V1_{Bk}$ and $V1_C$ are switched between opening and closing, the sub tank $151_{Bk}$ and the sub tank $151_C$ are in the state where the insides thereof are not decompressed. Consequently, it is not necessary to open the insides of the sub tanks to the atmosphere at the time of switching between opening and closing of these tank supply valves.

After this, in a case of detecting that the sub tank $151_M$ is filled with a predetermined amount of the M ink by using the liquid surface detection unit 151*a*, the print controller 202 suspends the decompression pump P0 by controlling the ink supply control unit 209.

Next, the print controller 202 opens the tank supply valve $V1_Y$ by controlling the ink supply control unit 209. Due to this, the preparation for supply of the Y ink from the main tank $141_Y$ to the sub tank $151_Y$ is completed.

Next, the print controller 202 drives the decompression pump P0 by controlling the ink supply control unit 209. Due to this, the Y ink is drawn into the sub tank $151_Y$ from the main tank $141_Y$. After this, in a case of detecting that the sub tank $151_Y$ is filled with a predetermined amount of the Y ink by using the liquid surface detection unit 151*a*, the print controller 202 suspends the decompression pump P0 by controlling the ink supply control unit 209. Subsequent processing is the same as that at S1014 and S1015 in FIG. 10. The above is the contents of the ink replenishment processing in a case of replenishment of the M ink and the Y ink in the present embodiment.

About Effect of the Present Embodiment

As explained above, in the present embodiment, in a case where the order of replenishment of the sub tanks with inks and the order of opening of the tank supply valves are different for each color ink, the decompression pump is driven for the first time after opening the tank supply valve corresponding to the color ink that is replenished first. By the present embodiment, it is no longer necessary to open the inside of the sub tank to the atmosphere at the time of switching between opening and closing of the tank supply valve of each color ink for the purpose of opening the tank supply valve corresponding to the color ink that is replenished first. Consequently, it is possible to reduce the time required for the ink replenishment processing.

Third Embodiment

In the above-described embodiment, the aspect is explained in which the shaft configuring the tank supply valve drive mechanism is rotated in the normal rotation direction (forward direction) and tank supply valves of each color are opened in the order of $V1_{Bk} \rightarrow V1_C \rightarrow V1_M \rightarrow V1_Y$ (see FIG. 7). In contrast to this, in the present embodiment, an aspect is explained in which the shaft is rotated in the direction opposite to the normal rotation direction (this direction is defined as a reverse rotation direction or backward direction) and the tank supply valves of each color are opened in the order of $V1_Y \rightarrow V1_M \rightarrow V1_C \rightarrow V1_{Bk}$.

<About Case where Shaft is Rotated in Reverse Rotation Direction>

In the following, a case where the shaft is rotated in the reverse rotation direction is explained by taking a case where each sub tank is replenished with the Bk ink and the Y ink, respectively, in the ink supply unit shown in FIG. 6 as an example. In the present embodiment, it is assumed that the shaft 703 can rotate in the normal rotation direction or the reverse rotation direction.

In this case, first, the print controller 202 opens the decompression valve V7 by controlling the ink supply control unit 209 and then opens the tank supply valve $V1_{Bk}$. Due to this, the preparation for supply of the Bk ink from the main tank $141_{Bk}$ to the sub tank $151_{Bk}$ is completed.

Next, the print controller 202 drives the decompression pump P0 by controlling the ink supply control unit 209. Due to this, the Bk ink is drawn into the sub tank $151_{Bk}$ from the main tank $141_{Bk}$. After this, in a case of detecting that the sub tank $151_{Bk}$ is filled with a predetermined amount of the Bk ink by using the liquid surface detection unit 151*a*, the print controller 202 suspends the decompression pump P0 by controlling the ink supply control unit 209.

Next, the print controller 202 opens the tank supply valve $V1_Y$ by controlling the ink supply control unit 209. Due to this, the preparation for supply of the Y ink from the main tank $141_Y$ to the sub tank $151_Y$ is completed. As described above, in the present embodiment, the shaft 703 is rotated in the reverse rotation direction, and therefore, the tank supply valve $V1_Y$ opens next to the tank supply valve $V1_{Bk}$. Consequently, at the time of changing the state from the state where the tank supply valve $V1_{Bk}$ is open into the state where the tank supply valve $V1_Y$ is open, the state where the tank supply valves $V1_C$ and $V1_M$ are open is not interposed. Because of this, it does not become necessary to open the insides of the sub tank $151_C$ and the sub tank $151_M$ to the atmosphere at the time of switching between opening and closing of the tank supply valve.

Next, the print controller 202 drives the decompression pump P0 by controlling the ink supply control unit 209. Due to this, the Y ink is drawn into the sub tank $151_Y$ from the main tank $141_Y$. After this, in a case of detecting that the sub tank $151_Y$ is filled with a predetermined amount of the Y ink by using the liquid surface detection unit 151*a*, the print controller 202 suspends the decompression pump P0 by controlling the ink supply control unit 209. Subsequent processing is the same as that at S1014 and S1015 in FIG. 10. The above is the contents of the ink replenishment processing in a case of replenishment of the Bk ink and the Y ink in the present embodiment.

About Effect of the Present Embodiment

In the present embodiment, in a case where the color ink corresponding to the tank supply valve that opens first and the color ink corresponding to the tank supply valve that opens last on a condition that the shaft is rotated in the normal rotation direction are included in the replenishment-target color inks, the sub tank of each color is replenished with the color ink while rotating the shaft in the reverse rotation direction.

By rotating the shaft in the reverse rotation direction, it is no longer necessary to open the inside of the sub tank to the atmosphere, which is necessary in a case where the sub tank of each color is replenished with the color ink while rotating the shaft in the normal rotation direction, and therefore, it is possible to reduce the time required for the ink replenishment processing accordingly.

Fourth Embodiment

As described previously, the replenishment of ink from the main tank 141 to the sub tank 151 is performed by making negative the pressure inside the sub tank 151 by the decompression pump P0. In a case where the ink in the main tank 141 runs out during the replenishment of the sub tank 151, it becomes necessary to abort the replenishment and to exchange the main tank 141. At this time, by closing the tank supply valve V1 before detaching the main tank 141 from the printing apparatus 1, it is possible to keep the negative pressure inside the sub tank 151. Then, by opening the tank supply valve V1 after the new main tank 141 is attached, it is possible to resume the replenishment of ink from the state where the negative pressure is kept. Due to this, it is not necessary to make negative the pressure inside the sub tank 151 again, and therefore, it is possible to reduce the time required for replenishment of ink.

<About Ink Replenishment Processing Accompanied by Ink Tank Exchange>

Figure 11:
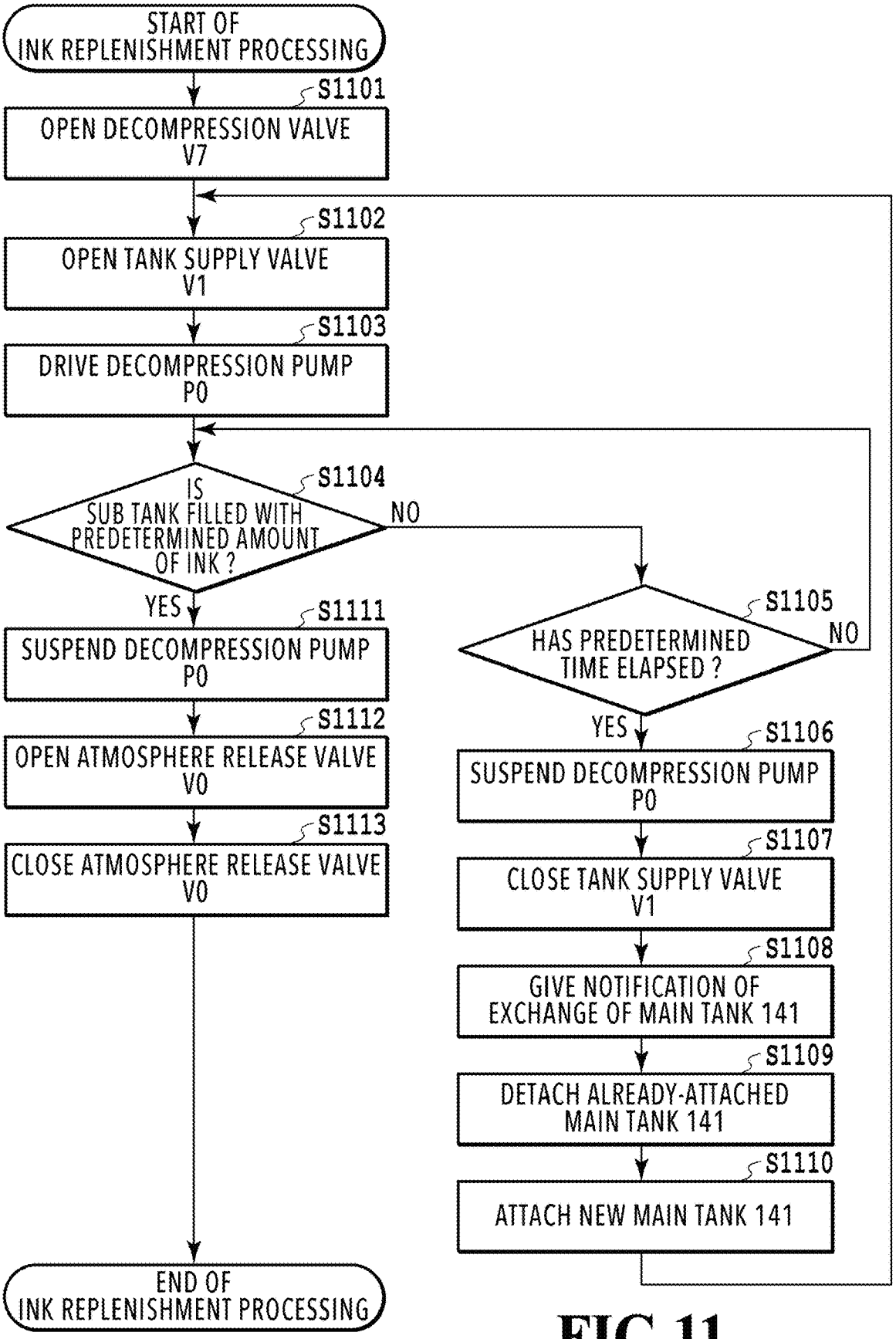
FIG. 11 is a flowchart of ink replenishment processing in a fourth embodiment.

In the following, ink replenishment processing in a case where it becomes necessary to exchange the main tank 141 during replenishment in the present embodiment is explained by using FIG. 11.

At S1101, the print controller 202 opens the decompression valve V7 by controlling the ink supply control unit 209. At S1102, the print controller 202 opens the tank supply valve V1 by controlling the ink supply control unit 209. By this step, the preparation for supply of ink from the main tank 141 to the sub tank 151 is completed.

At S1103, the print controller 202 drives the decompression pump P0 by controlling the ink supply control unit 209. By this step, the pressure within the sub tank 151 becomes negative, and therefore, ink is drawn into the sub tank 151 from the main tank 141.

At S1104, the print controller 202 determines whether the sub tank 151 is filled with a predetermined amount of ink. At this step, the print controller 202 performs the detection operation to detect whether the sub tank 151 is filled with a predetermined amount of ink by the liquid surface detection unit 151*a*. In a case where determination results at this step are affirmative, the processing advances to S1111 and on the other hand, in a case where the determination results are negative, the processing advances to S1105.

At S1105, the print controller 202 determines whether a predetermined time has elapsed after driving the decompression pump P0 at S1103. Here, a "predetermined time" is a time required for the empty sub tank 151 to be filled with a predetermined amount of ink in a case where ink is drawn into the sub tank 151 at a predetermined negative pressure by using the decompression pump P0. In a case where determination results at this step are affirmative, the processing advances to S1106 by regarding the ink in the main tank 141 as having run out and on the other hand, in a case where the determination results are negative, the processing returns to S1104.

In a case where it is determined that a predetermined time has elapsed at S1105 (in a case of YES at S1105), the print controller 202 suspends the decompression pump P0 by controlling the ink supply control unit 209 at S1106. At S1107, the print controller 202 closes the tank supply valve V1 by controlling the ink supply control unit 209. Due to this, also in the subsequent exchange work of the main tank 141, the negative pressure inside the sub tank 151 is kept.

At S1108, the print controller 202 gives a user a notification to the effect that it is necessary to exchange the main tank 141 via the operation panel 104 or the like. At S1109, a user detaches the main tank 141 from the printing apparatus 1 and at S1110, a user attaches the new main tank 141 to the printing apparatus 1.

At S1102, the print controller 202 opens the tank supply valve V1 again by controlling the ink supply control unit 209. By the flow of such processing, it is possible to quickly replenish the main tank 141 with ink by the negative pressure kept inside the sub tank 151.

Figure 5:
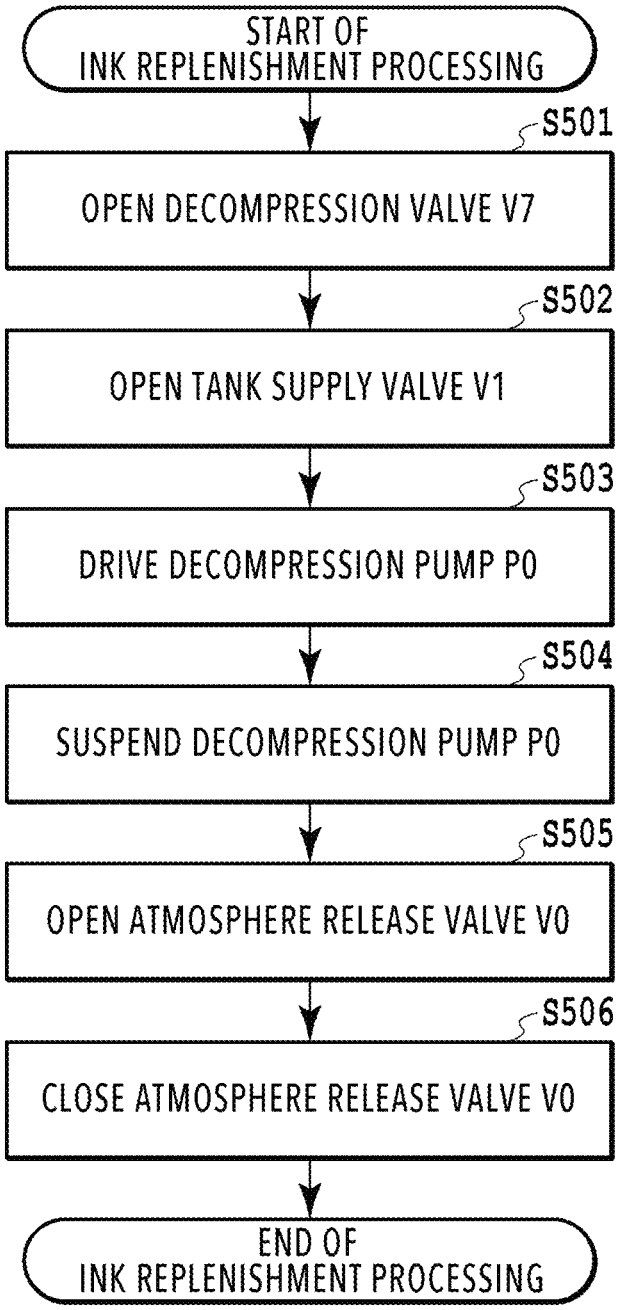
FIG. 5 is a flowchart of ink replenishment processing in the first embodiment.

Processing at S1111 to S1113 that is performed in a case where it is determined that the sub tank 151 is filled with a predetermined amount of ink at S1104 (in a case of YES at S1104) is the same as the processing at S504 to S506 shown in FIG. 5.

In a case where the air flow paths of each color (that is, the flow path C6) are integrated as shown in the previous embodiments, it is necessary to perform the opening/closing operation of the tank supply valve V1 of the ink color for which the above-described main tank exchange is performed without opening the tank supply valves V1 of the other colors. The reason is to keep the negative pressure within the sub tanks 151 of the other colors. In the aspect in which the opening/closing operation of the tank supply valve V1 of each color is performed by an identical drive source, such as the drive mechanism 700 shown in FIG. 7, in a case where the opening/closing order of the tank supply valves is in one direction, it is sufficient to adopt the combination of opening/closing shown in FIG. 12. By adopting the combination such as this, it is made possible to perform the opening/closing operation of only the tank supply valve V1 of the replenishment-target color. Further, in a case where it is possible to rotate the shaft in the reverse rotation direction, it is sufficient to adopt the combination of opening/closing shown in FIG. 13. As described above, by bringing the tank supply valves of all the colors into the closed state at the cam positions before and after the cam position at which the tank supply valve of each color enters the open state, it is made possible to apply the present embodiment. The above is the contents of the ink replenishment processing accompanied by the ink tank exchange in the present embodiment.

<About Specific Example of Ink Replenishment Processing Accompanied by Ink Tank Exchange>

Figure 14:
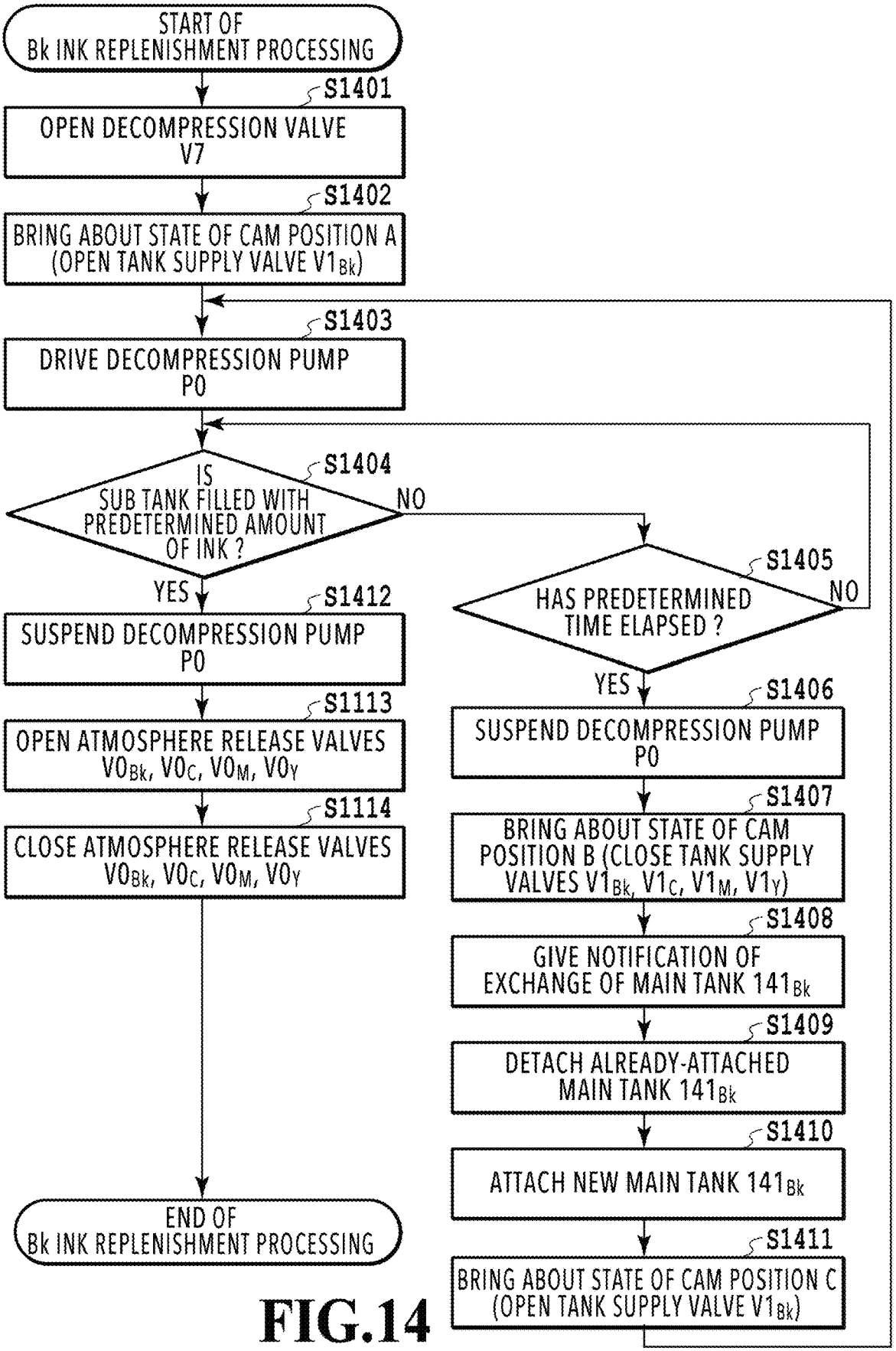
FIG. 14 is a flowchart of ink replenishment processing in the fourth embodiment.

In the following, as an example of an ink replenishing operation in the present embodiment, a case where the sub tank $\mathbf{151}_{Bk}$ is replenished with the Bk ink in the cam configuration in FIG. 12 is explained by using FIG. 14.

At S1401, the print controller 202 opens the decompression valve V7 by controlling the ink supply control unit 209. At S1402, the print controller 202 opens the tank supply valve $\mathbf{V1}_{Bk}$ by controlling the ink supply control unit 209 (brings about the state of the cam position A). By this step, the preparation for supply of ink from the main tank $\mathbf{141}_{Bk}$ to the sub tank $\mathbf{151}_{Bk}$ is completed.

At S1403, the print controller 202 drives the decompression pump P0 by controlling the ink supply control unit 209.

By this step, the pressure within the sub tank $151_{Bk}$ becomes negative, and therefore, ink is drawn into the sub tank $151_{Bk}$ from the main tank $141_{Bk}$.

At S1404, the print controller 202 determines whether the sub tank $151_{Bk}$ is filled with a predetermined amount of ink. At this step, the print controller 202 performs the detection operation to detect whether the sub tank $151_{Bk}$ is filled with a predetermined amount of the Bk ink by the liquid surface detection unit 151*a*. In a case where determination results at this step are affirmative, the processing advances to S1412 and on the other hand, in a case where the determination results are negative, the processing advances to S1405.

At S1405, the print controller 202 determines whether a predetermined time has elapsed after driving the decompression pump P0 at S1403. Here, a "predetermined time" is a time required for the empty sub tank $151_{Bk}$ to be filled with a predetermined amount of the Bk ink in a case where ink is drawn into the sub tank $151_{Bk}$ at a predetermined negative pressure by using the decompression pump P0. In a case where the determination results at this step are affirmative, the processing advances to step S1406 by regarding the ink in the main tank $141_{Bk}$ as having run out and on the other hand, in a case where the determination results are negative, the processing returns to S1404.

In a case where it is determined that a predetermined time has elapsed at S1405 (in a case of YES at S1405), the print controller 202 suspends the decompression pump P0 by controlling the ink supply control unit 209 at S1406. At S1407, the print controller 202 closes the tank supply valve $V1_{Bk}$ by controlling the ink supply control unit 209 (brings about the state of the cam position B). Due to this, also in the subsequent main tank $141_{Bk}$ exchange work, the negative pressure within the sub tank $151_{Bk}$ is kept.

At S1408, the print controller 202 gives a user a notification to the effect that it is necessary to exchange the main tank $141_{Bk}$ via the operation panel 104 or the like. At S1409, a user detaches the main tank $141_{Bk}$ from the printing apparatus 1. At S1410, a user attaches the new main tank $141_{Bk}$ to the printing apparatus 1.

At S1411, the print controller 202 opens the tank supply valve $V1_{Bk}$ by controlling the ink supply control unit 209 (brings about the state of the cam position C). By the flow of processing such as this, it is possible to quickly replenish the main tank $141_{Bk}$ with ink by the negative pressure kept inside the sub tank $151_{Bk}$.

Processing at S1412 to S1414 that is performed in a case where it is determined that the sub tank $151_{Bk}$ is filled with a predetermined amount of ink at S1404 (in a case of YES at S1404) is the same as the processing at S504 to S506 shown in FIG. 5. The above is the contents of the specific example of the ink replenishment processing accompanied by the ink tank exchange in the present embodiment.

About Effect of the Present Embodiment

According to the present embodiment, it is not necessary to make negative the pressure within the sub tank 151 again, and therefore, it is possible to reduce the time of replenishment of ink.

OTHER EMBODIMENTS

In the above-described embodiments, the case where the inks of four colors of CMYBk are used is explained, but inks to be used are not limited to those and it is possible to apply the present invention to any printing apparatus using a plurality of color inks. Further, it may also be possible to combine the above-described embodiments.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

By the present invention, in a case where sub tanks are replenished with ink in order different from color order of opening of the drive valves, it is made possible to prevent a sub tank that does not need replenishment from being replenished with ink.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2018-065381, filed Mar. 29, 2018, and No. 2018-172667, filed Sep. 14, 2018, which are hereby incorporated by reference wherein in their entirety.

What is claimed is:

1. A printing apparatus comprising:

a print head capable of ejecting a first ink, a second ink, and a third ink;

a plurality of first tanks each provided for an ink and storing the ink to be supplied to the print head;

a plurality of second tanks each provided for an ink and storing the ink with which a corresponding one of the first tanks is replenished;

a plurality of supply valves each provided for an ink and opening and closing an ink flow path connecting corresponding ones of the second tank and the first tank;

a plurality of atmosphere release valves each provided for an ink and for opening an inside of a corresponding one of the first tanks to the atmosphere;

a pump for generating negative pressure within each of the first tanks, and a controller for controlling opening and closing of the supply valves and the atmosphere release valves, wherein the printing apparatus performs a replenishment operation to replenish the first tank with ink from the second tank by driving the pump in a state where each said atmosphere release valve is closed and one said supply valve is open, the controller opens the supply valve of the first ink, the supply valve of the second ink, and the supply valve of the third ink, one-by-one in the order, and in a case where one of the supply valve of the first ink, the supply valve of the second ink, and the supply valve of the third ink is open, the other two supply valves are closed, and in a case where replenishment of the first ink and the third ink is necessary and replenishment of the second ink is not necessary, the controller opens at least the atmosphere release valve of the second ink after the supply valve of the first ink is closed and before the supply valve of the second ink is opened.

2. The printing apparatus according to claim 1, wherein in a case where it becomes necessary to exchange the second tank during the replenishment operation, the controller closes the supply valve of the first ink, the supply valve of the second ink, and the supply valve of the third ink.

3. The printing apparatus according to claim 1, wherein the pump is used in common by the plurality of first tanks.

4. The printing apparatus according to claim 3, wherein the pump is arranged in an air flow path communicating with an air chamber in which air is stored in the first tanks.

5. The printing apparatus according to claim 1, wherein the supply valve of the first ink is, the supply valve of the second ink, and the supply valve of the third ink, are driven by an identical drive source.

6. The printing apparatus according to claim 5, further comprising:

a drive mechanism driving the plurality of supply valves, wherein the drive mechanism includes cams corresponding to each ink and each of the cams opens the supply valve of a corresponding ink at a different rotation angle.

7. The printing apparatus according to claim 6, wherein in a case where the controller causes the cam for the first ink, the cam for the second ink, and the cam for the third ink, to rotate in a first direction, the supply valve of the first ink, the supply valve of the second ink, and the supply valve of the third ink open in the order.

8. The printing apparatus according to claim 7, wherein the cam for the first ink, the cam for the second ink, and the cam for the third ink, are each capable of rotating in a second direction opposite to the first direction and in a case where replenishment of the first ink and the third ink is necessary and replenishment of the second ink is not necessary, after performing a replenishment operation of the first ink by rotating the cam for the first ink, the cam for the second ink, and the cam for the third ink in the first direction and after closing the supply valve of the first ink, the controller performs a replenishment operation of the third ink by rotating the cam for the first ink, the cam for the second ink, and the cam for the third ink in the second direction to open the supply valve of the third ink without opening the atmosphere release valve of the second ink.

9. The printing apparatus according to claim 1, wherein in a case where replenishment of the first ink and the second ink is necessary, the controller does not open the atmosphere release valves after the supply valve of the first ink is closed and before the supply valve of the second ink is opened.

10. A control method of a printing apparatus wherein the printing apparatus comprises: a print head capable of ejecting a first ink, a second ink, and a third ink; a plurality of first tanks each provided for an ink and storing the ink to be supplied to the print head; a plurality of second tanks each provided for an ink and storing the ink with which a corresponding one of the first tanks is replenished; a plurality of supply valves each provided for an ink and opening and closing an ink flow path connecting corresponding ones of the second tank and the first tank; a plurality of atmosphere release valves each provided for an ink and for opening an inside of a corresponding one of the first tanks to the atmosphere; a pump for generating negative pressure within each of the first tanks; and a controller for controlling opening and closing of the supply valves and the atmosphere release valves, wherein the controller opens the supply valve of the first ink, the supply valve of the second ink, and the supply valve of the third ink, one-by-one in the order, and in a case where one of the supply valve of the first ink, the supply valve of the second ink, and the supply valve of the third ink is open, the other two supply valves are closed, the control method comprising:

a replenishment step of performing, by the controller, a replenishment operation to replenish the first tank with ink from the second tank by driving the pump in a state where each said atmosphere release valve is closed and one said supply valve is open; and an atmosphere open step of opening, by the controller, in a case where replenishment of the first ink and the third ink is necessary and replenishment of the second ink is not necessary, at least the atmosphere release valve of the second ink after the supply valve of the first ink is closed and before the supply valve of the second ink is opened.

11. The printing apparatus according to claim 1, wherein the controller opens a supply valve corresponding to ink to be firstly supplied out of the supply valve of the first ink, the supply valve of the second ink, and the supply valve of the third ink, and then drives the pump.

12. A non-transitory storage medium storing a program causing a computer to perform a control method of a printing apparatus, wherein the printing apparatus comprises: a print head capable of ejecting a first ink, a second ink, and a third ink; a plurality of the first tanks each provided for an ink and storing the ink to be supplied to the print head; a plurality of second tanks each provided for an ink and storing the ink with which a corresponding one the first tanks is replenished; a plurality of supply valves each provided for an ink and opening and closing an ink flow path connecting corresponding ones of the second tank and the first tank; a plurality of atmosphere release valves each provided for an ink and for opening an inside of a corresponding one of the first tanks to the atmosphere; a pump for generating negative pressure within each of the first tanks; and a controller for controlling opening and closing of the supply valves and the atmosphere release valves, wherein the controller opens the supply valve of the first ink, the supply valve of the second ink, and the supply valve of the third ink, one-by-one in the order, and in a case where one of the supply valve of the first ink, the supply valve of the second ink, and the supply valve of the third ink is open, the other two supply valves are closed, the control method comprising:

a replenishment step of performing, by the controller, a replenishment operation to replenish the first tank with ink from the second tank by driving the pump in a state where each said atmosphere release valve is closed and one said supply valve is open; and an atmosphere open step of opening, by the controller, in a case where replenishment of the first ink and the third ink is necessary and replenishment of the second ink is not necessary, at least the atmosphere release valve of the second ink after the supply valve of the first ink is closed and before the supply valve of the second ink is opened.

* * * * *